US010274877B2

(12) United States Patent
Maeda et al.

(10) Patent No.: US 10,274,877 B2
(45) Date of Patent: Apr. 30, 2019

(54) FIXING DEVICE HAVING A CONTROL PORTION THAT CONTROLS A HEATING TEMPERATURE OF A HEATING UNIT IN A HALT STATE ACCORDING TO A HEATING TEMPERATURE OF THE HEATING UNIT IN A ROTATING STATE

(71) Applicant: CANON FINETECH NISCA INC., Saitama (JP)

(72) Inventors: Akihiro Maeda, Tokyo (JP); Shohei Tsuzaki, Saitama (JP); Hiroshi Morita, Tokyo (JP)

(73) Assignee: Canon Finetech Nisca Inc., Misato-shi (JP)

( * ) Notice: Subject to any disclaimer, the term of this patent is extended or adjusted under 35 U.S.C. 154(b) by 0 days.

(21) Appl. No.: 15/709,676

(22) Filed: Sep. 20, 2017

(65) Prior Publication Data

US 2018/0088501 A1 Mar. 29, 2018

(30) Foreign Application Priority Data

Sep. 29, 2016 (JP) ..... 2016-191158
Jun. 14, 2017 (JP) ..... 2017-117027

(51) Int. Cl.
*G03G 15/20* (2006.01)

(52) U.S. Cl.
CPC ..... *G03G 15/2039* (2013.01); *G03G 15/205* (2013.01); *G03G 15/2028* (2013.01); *G03G 15/2046* (2013.01); *G03G 2215/2035* (2013.01)

(58) Field of Classification Search
None
See application file for complete search history.

(56) References Cited

U.S. PATENT DOCUMENTS

| | | | |
|---|---|---|---|
| 6,175,699 | B1 | 1/2001 | Kato et al. |
| 6,185,388 | B1 | 2/2001 | Yamamoto |
| 2009/0310998 | A1 | 12/2009 | Otsuka |
| 2013/0142532 | A1 | 6/2013 | Kitagawa et al. |

FOREIGN PATENT DOCUMENTS

| | | | |
|---|---|---|---|
| EP | 2600208 | A2 | 6/2013 |
| JP | 11-344894 | A | 12/1999 |

OTHER PUBLICATIONS

European Search Report dated Jan. 25, 2018, issued in European Application No. 17193386.4.
Extended European Search Report dated May 7, 2018, issued in European Patent Application No. 17193386.4.

*Primary Examiner* — Sevan A Aydin
(74) *Attorney, Agent, or Firm* — Venable LLP

(57) ABSTRACT

A fixing device includes a rotating unit, a heating unit configured to heat the rotating unit, and a pressure member configured to nip a recording material between the rotating unit and the pressure member and to convey the recording material. In addition, a control portion is configured to variably control, when the rotating unit is changed from a rotating state to a halt state, a heating temperature of the heating unit in the halt state according to the heating temperature of the heating unit in the rotating state.

6 Claims, 28 Drawing Sheets

*FIG. 6*

| TEMPERATURE DIFFERENCE BETWEEN TEMPERATURE INSIDE NIP AND OUTSIDE NIP [℃] | AMOUNT OF STRAIN [μm] | PRESENCE/ABSENCE OF DENT MARK OF FILM |
|---|---|---|
| 80 | 35 | ABSENT |
| 85 | 40 | ABSENT |
| 90 | 45 | ABSENT |
| 95 | 50 | PRESENT |
| 100 | 55 | PRESENT |

*FIG. 24*

| | WIDTH OF FIXING NIP PORTION IN SHEET CONVEYING DIRECTION N (mm) | | |
|---|---|---|---|
| | 8≦N<9 | 9≦N<10 | 10≦N<11 |
| THRESHOLD VALUE $\nu$ (°C) | 90 | 80 | 70 |

FIXING DEVICE HAVING A CONTROL PORTION THAT CONTROLS A HEATING TEMPERATURE OF A HEATING UNIT IN A HALT STATE ACCORDING TO A HEATING TEMPERATURE OF THE HEATING UNIT IN A ROTATING STATE

BACKGROUND OF THE INVENTION

Field of the Invention

The present invention relates to a fixing device suitable for an image forming apparatus that forms an image on a recording medium using, for example, an electro-photographic system, and a method of controlling the fixing device. The present invention also relates to an image forming apparatus with a fixing device, such as an electro-photographic copying machine, a laser beam printer, a facsimile machine, or the like.

Description of the Related Art

As a fixing device mounted on an electro-photographic image forming apparatus, the configuration having a heater, a film (rotating unit) that is rotated while being heated in contact with the heater, and a pressure roller (pressure member) that is rotated while pressing the film is known. In this configuration, a recording material bearing an unfixed toner image (developer image) is heated while being nipped and conveyed at a fixing nip portion formed by the film and the pressure roller, thereby fixing the image on the recording material.

Here, it is ideal that all of the unfixed toner image on the recording material is fixed by being properly heated and melted. When there exists toner that is not dissolved by heat, however, toner that is dissolved too much, or toner that is electrostatically attached to the pressure roller or the film, such toner is transferred to the pressure roller or the film, and the toner that has been transferred to the film is further transferred to the pressure roller between sheets.

When the fixing operation is repeated in this state, the toner transferred to the pressure roller accumulates. When the accumulated toner exceeds a predetermined accumulation amount, the toner on the pressure roller adheres to the back surface of a subsequent recording material, thereby generating conspicuous toner contamination on the back surface of the recording material.

Therefore, in Japanese Patent Application Laid-Open No. H11-344894, the configuration is proposed in which a discharge control is performed to transfer the toner on the pressure roller to the film by heating the film until the film reaches a temperature equal to or greater than the softening point of the toner with the film being stopped after the completion of the fixing operation. By performing such discharge control, the pressure roller can be cleaned, and toner contamination on the back surface of the recording material can be suppressed.

In the configuration disclosed in Japanese Patent Application Laid-Open No. H11-344894, however, when the film is continuously heated with the film being stopped, the temperature rises greatly only in the fixing nip portion that is in contact with the heater, and the temperature of the portion other than the fixing nip portion does not largely change from the ambient temperature. As described above, when the pressure roller is suddenly driven in a state in which a temperature difference is generated between the fixing nip portion and the other portion in the rotation direction of the film, the film is deformed, causing a risk of generating a dent mark, as described below.

FIGS. 27A and 27B are schematic views of a film for explaining the mechanism of deformation of the film. FIG. 27A is a diagram showing a state in which the temperature of the heater is raised with the film being stopped (non-rotating state). FIG. 27B is a diagram showing the case in which the film is driven to rotate by rotating the pressure roller from the state shown in FIG. 27A.

As shown in FIG. 27A, when the temperature of the heater is increased with the film being stopped, the film in the vicinity of the fixing nip portion (broken line portion) locally thermally expands and the other portion (solid line portion) does not thermally expand. For this reason, thermal stress is applied in the vicinity of the boundary between the portion that has thermally expanded and the portion that has not thermally expanded in the rotation direction (circumferential direction) of the film, and distortion occurs in the film. As the temperature difference between inside the nip and outside the nip of the film increases, the amount of distortion increases due to the difference of expansion amount.

Next, as shown in FIG. 27B, when the film rotates with a thermal stress being applied, the film is pulled by the pressure roller, and the stress is further concentrated near the boundary between the portion that has thermally expanded and the portion that has not thermally expanded, thereby permanently deforming the film, causing a dent mark to generate.

When the fixing process is performed with a dent mark, the film surface does not contact the recording material at the dent mark portion, so that heat is not transferred to the toner and the fixing becomes insufficient, thereby generating image failure, such as a whitened out image. Such image failure is remarkably generated particularly in a low temperature environment in which securing of fixing ability is relatively difficult. Also, if the film is continuously used with the dent mark, the bending of a dent mark may be repeated many times and the film may crack.

SUMMARY OF THE INVENTION

An object of the present invention is to provide a fixing device capable of suppressing deformation of a rotating unit that rotates and heats a developer image on a recording material.

In one aspect, the present invention provides a fixing device comprising a rotating unit, a heating unit configured to heat the rotating unit, a pressure member configured to nip a recording material between the rotating unit and the pressure member and to convey the recording material, and a control portion configured to variably control, when the rotating unit is changed from a rotating state to a halt state, a heating temperature of the heating unit in the halt state according to a heating temperature of the heating unit in the rotating state.

Further features of the present invention will become apparent from the following description of exemplary embodiments with reference to the attached drawings.

BRIEF DESCRIPTION OF THE DRAWINGS

FIG. 6 is a table showing results of experiment in which a dent mark of a film is generated.

FIG. 24 is a table in which the widths of the fixing nip portion in the sheet conveying direction and the threshold values relating to the temperature difference between inside the nip and outside the nip of the film at the time of driving the pressure roller are associated with each other.

DESCRIPTION OF THE EMBODIMENTS

First Embodiment

Image Forming Apparatus

Hereafter, an overall configuration of the image forming apparatus A including a fixing device according to the first embodiment of the present invention will be described with reference to the drawings, together with an image forming operation. The type, shape, arrangement, number, and so on, of the members are not limited to those in the following embodiments, and it is possible to change the configuration within the scope not deviating from the gist of the invention, such as appropriately replacing the constituent elements with those having equivalent functions and effects.

Figure 1:
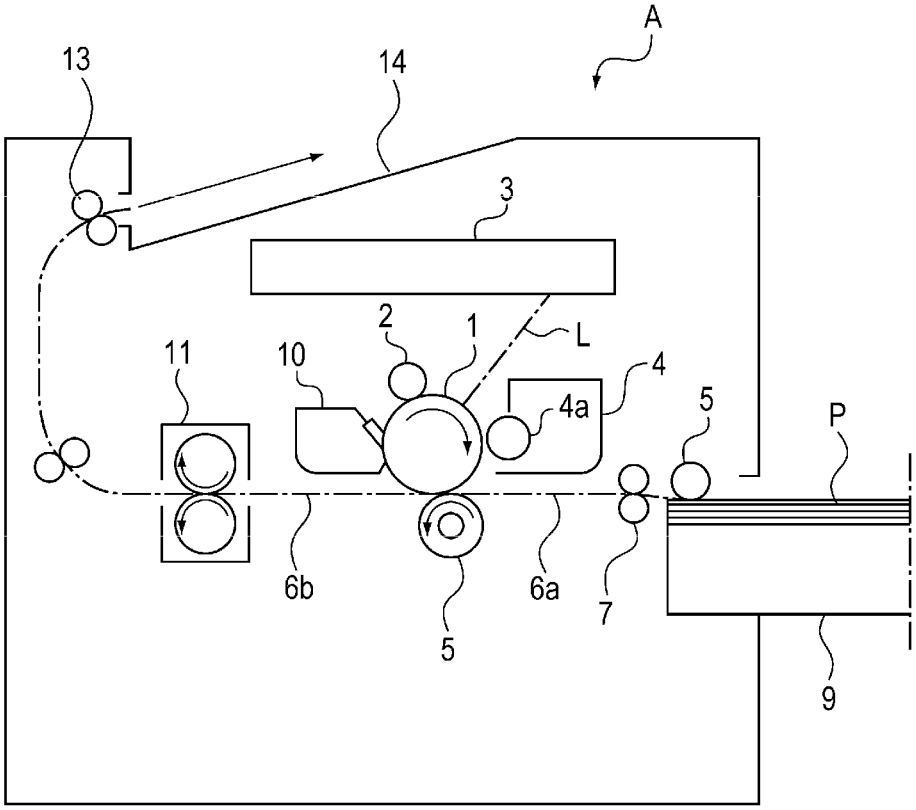
FIG. 1 is a diagram showing a schematic cross-sectional view of an image forming apparatus.

As shown in FIG. 1, the image forming apparatus A includes an image forming portion that transfers a toner image to a sheet P, as a recording material, a sheet feeding portion that supplies the sheet P to the image forming portion, and a fixing portion that fixes the toner image on the sheet P.

The image forming portion includes a photosensitive drum 1, a charging roller 2, a laser scanner unit 3, a developing device 4, a transfer roller 5, and so on.

Figure 4:
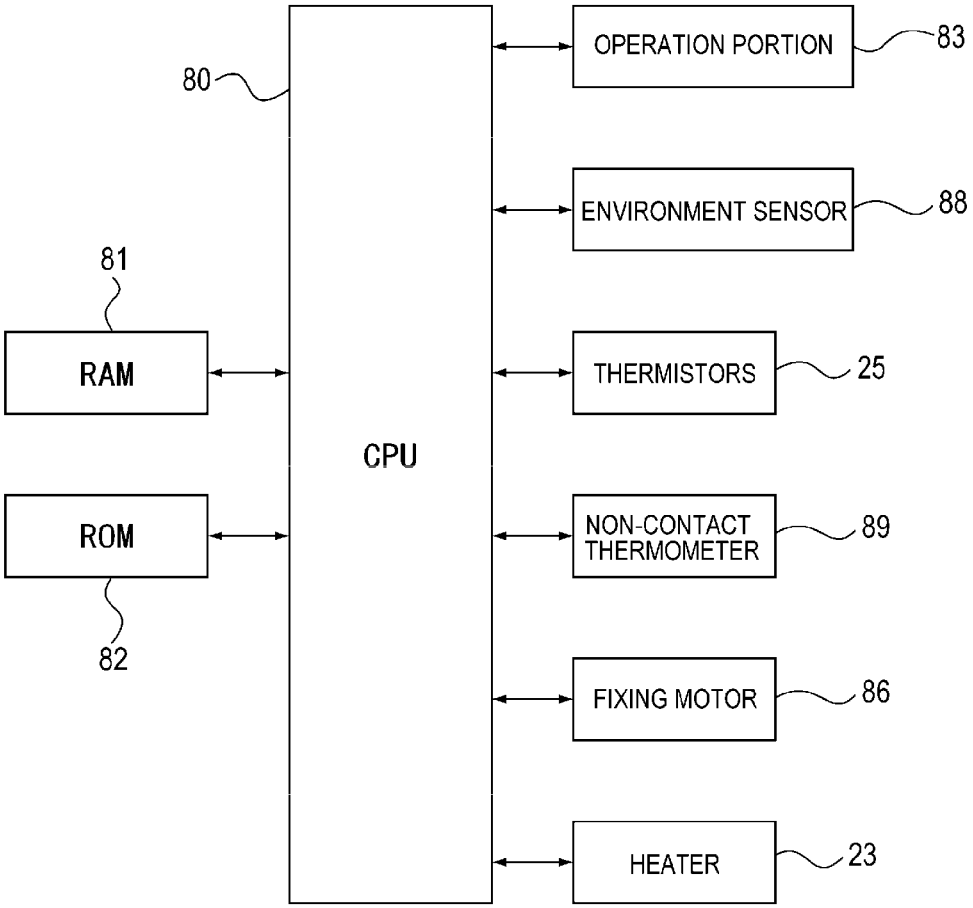
FIG. 4 is a block diagram showing a configuration of a control portion of the image forming apparatus.

In image formation, when a central processing unit (CPU) 80 shown in FIG. 4 receives an image forming job signal, the sheet P, stacked and stored in a sheet stacking portion 9, is fed to a registration roller 7 by a feeding roller 6. Thereafter, timing correction is performed with the image forming portion and the sheet P is conveyed to the image forming portion by the registration roller 7.

On the other hand, in the image forming portion, by applying a charging bias to the charging roller 2, the surface of the photosensitive drum 1 that is in contact with the charging roller 2 is charged. Then, laser light L is emitted from a light source (not shown) provided inside the laser scanner unit 3 and the laser light L is irradiated to the photosensitive drum 1. As a result, the potential of the photosensitive drum 1 is partially lowered and an electrostatic latent image corresponding to image information is formed on the surface of the photosensitive drum 1.

Thereafter, by applying a developing bias to the developing sleeve 4*a* of the developing device 4, the toner on the developing sleeve 4*a* is adhered to the electrostatic latent image formed on the surface of the photosensitive drum 1 to form a toner image (developer image). The toner image formed on the surface of the photosensitive drum 1 is sent to a transfer nip portion formed between the photosensitive drum 1 and the transfer roller 5. When the toner image arrives at the transfer nip portion, a transfer bias having a polarity opposite to that of the toner is applied to the transfer roller 5, and the toner image is transferred to the sheet P.

Thereafter, the sheet P on which the toner image has been transferred is conveyed to the fixing device 11 in which the toner image is heated and is pressed in the fixing operation of the fixing device 11 to permanently fix the toner image on the sheet P (on the recording material). Thereafter, the sheet P is conveyed by a discharge roller 13 and discharged to a discharge tray 15.

Fixing Device

Next, the configuration of the fixing device 11 will be described.

Figure 2:
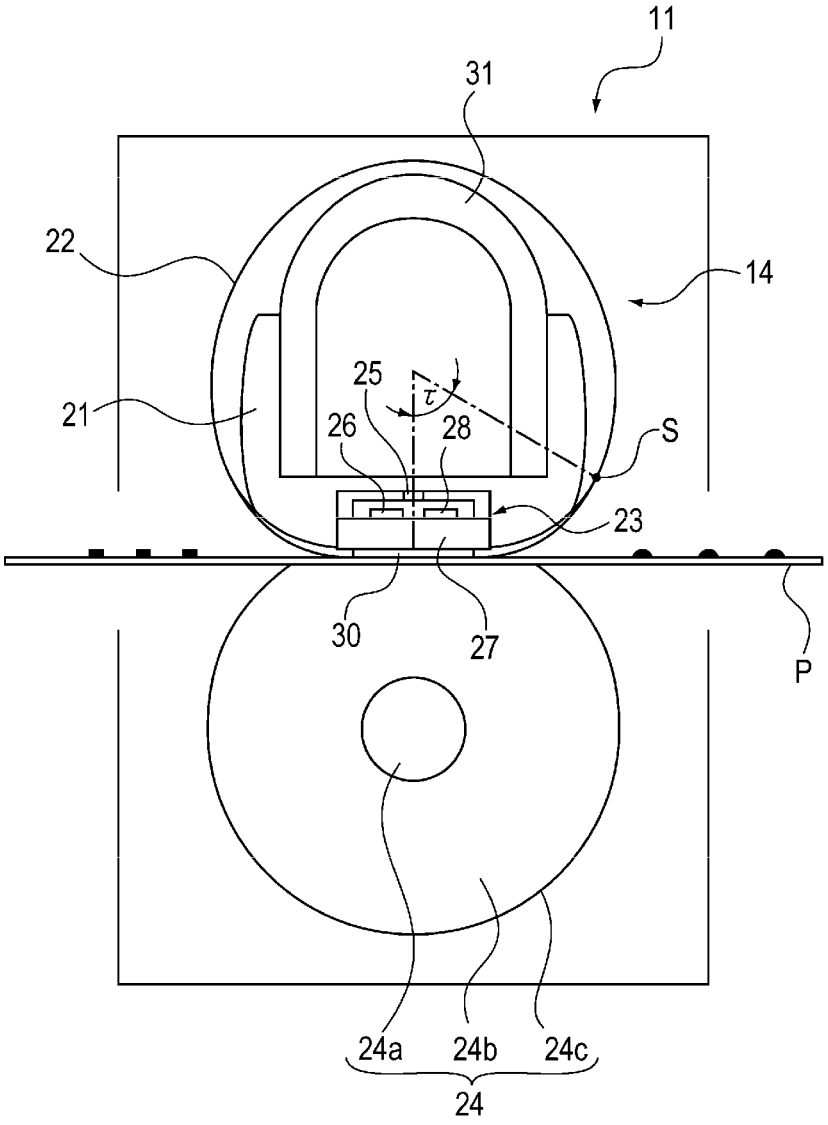
FIG. 2 is a diagram showing a schematic sectional view of a fixing device.

FIG. 2 is a diagram showing a schematic sectional view of the fixing device 11. As shown in FIG. 2, the fixing device 11 includes a heating unit 14 that heats a toner image born on the sheet P and that fixes the toner image on the sheet P by melting the toner. The fixing device 11 also includes a pressure roller 24 (pressure member) that pressurizes a film 22 of the heating unit 14 and nips and conveys the sheet P together with the film 22.

The pressure roller 24 is composed of a metal core 24*a* that is a rotation shaft, an elastic layer 24*b* provided around the metal core 24*a*, and an outermost toner parting layer 24*c* provided around the elastic layer 24*b*. Both end portions of the metal core 24*a* are rotatably supported, and a gear (not shown), disposed on the end portion side, is rotated by receiving a driving force from a fixing motor 86 (see FIG. 4) so that the pressure roller 24 is rotated. Both ends of the metal core 24*a* of the pressure roller 24 are pressed toward the film 22 by a pressure spring (not shown) with a force of 120N. As a result, the pressure roller 24 presses the film 22.

In the present embodiment, the metal core 24*a* is made of aluminum, the elastic layer 24*b* is made of silicon rubber, and the toner parting layer 24 *c* is made of a perfluoroalkoxy alkane (PFA) tube. The outer diameter of the pressure roller 24 is 30 mm, the thickness of the toner parting layer 24*c* is 50 μm, and the total length in the longitudinal direction of the pressure roller 24 is 330 mm.

The heating unit 14 includes the film 22, a guide member 21 for holding the film 22, a U-shaped stay 31, a heater 23 for heating the film 22, a thermistor 25 (temperature detecting portion), a non-contact thermometer 89 (see FIG. 4) and so on.

The film 22 (rotating unit) is an endless cylindrical film-like member having a heat-resisting property, and is fitted over the guide member 21 which has a tub-shaped longitudinal cross-section formed of liquid crystal polymer. The film 22 is driven to rotate by frictional force between the rotating pressure roller 20 and the film 22. That is, in the present embodiment, the fixing motor 86, which transmits the driving force to the pressure roller 24 to rotate the pressure roller 24, is a driving portion that rotates the film 22.

Further, the inner peripheral length of the film 22 is greater than the outer peripheral length of the guide member 21 by approximately 3 mm, and the film 22 is fitted over the guide member 21 with a margin in the peripheral length. A lubricant (not shown) is applied between the inner circumferential surface of the film 22 and the outer circumferential surface of the guide member 21, whereby the sliding resistance is lowered when the guide member 21 and the inner circumferential surface of the film 22 rotate while being in contact with each other.

In addition, the film 22 is composed of three layers, including a base layer as a base material, a surface layer covering the surface of the base layer, and an adhesive layer that adheres the surface layer to the base layer. The base layer is a stainless steel film with a thickness of 40 μm, and PFA is coated on the outer circumferential surface of the base layer. Further, the outer diameter of the film 22 is set to 30 mm, and the total length in the longitudinal direction, which is the direction of the rotation axis of the pressure roller 24, is set to 340 mm to be able to cope with the passing of an A3-size sheet.

It is preferable that the thickness of the film 22 is 100 μm or less in order to lessen the heat capacity and to shorten a startup time. The base layer may be made of metal, such as nickel, or resin, such as polyimide, in addition to stainless steel. Further, instead of PFA, another fluorocarbon resin, such as polytetrafluoroethylene (PTFE), may be used for the surface layer to ensure a toner parting property from the toner. Furthermore, although a dent mark of the film 22 described above also can occur on the resin film, it is more likely to more remarkably occur in the case of the metallic film. This is because a dent mark will remain permanently once a material with a relatively small flexibility, such as metal, is locally deformed.

The U-shaped stay 31 is an elongated U-shaped metal extending in the longitudinal direction, and is disposed on the upper side of the guide member 21. The U-shaped stay 31 uniformly applies a pressure to the guide member 21, and has strength against the pressurization of the guide member 21 by the pressure roller 24. In addition, the thermal conductivity is increased in the longitudinal direction to improve temperature unevenness in the longitudinal direction. To realize such an effect, a metal having a high strength and a high thermal conductivity is generally used as a material of the U-shaped stay 31. In this embodiment, a galvanized steel plate is used as the material of the U-shaped stay 31.

The heater 23 is disposed inside the film 22 so as to be in contact with (and opposed to) the inner circumferential surface of the film 22 within the fixing nip portion to heat the film 22 from the inner circumferential surface. The heater 23 includes a heating resistor 26 (heating source) made of ceramics, which is thermally insulated, and fitted in a groove portion of a heater substrate 27 made of aluminum nitride. The heating resistor 26 generates heat by energization. In order to ensure insulation, the heating resistor 26 is covered with a glass coat 28. In order to ensure a sliding property with the film 22, a polyimide coating 30 having the width of 10 μm is printed on the surface of the heater substrate 27, the surface being in contact with the film 22. Further, a lubricant is applied between the film 22 and the polyimide coating 30 to further improve the sliding property at a time when the film 22 rotates. The heater substrate 27 is fitted and held in a groove having a concave shape formed along the longitudinal direction on the surface of the guide member 21 facing the pressurizing roller 24 so that the heater 23 is fixed to the guide member 21 via the heater substrate 27.

Thermistors 25 (first temperature detecting portion) for measuring the temperature of the heater 23 are disposed on the surface of the heater substrate 27 facing the guide member 21. A heat insulating layer is provided on a supporting member (not shown) of each of the thermistors 25. A chip thermistor element is fixed on the heat insulating layer. The chip thermistor element is pressed against the heater substrate 27 with a predetermined pressure so that the supporting member is in contact with the heater substrate 27.

As described above, the heater 23 is in contact with the film 22. As a result, the temperature of the contact area of the film 22 with the heater 23 is almost the same as the temperature of the heater 23. That is, the thermistor 25 is a heater temperature sensor that measures and detects the temperature of the contact area of the film 22 with the heater 23. In the present embodiment, since the contact area of the film 22 with the heater 23 is provided inside the fixing nip portion and the temperature of the contact area and the temperature of the fixing nip portion are substantially equal to each other, the temperature of the contact area is hereafter referred to as a temperature inside the nip.

Further, a non-contact thermometer 89 measures the temperature of the region of the film 22, which is not in contact with the heater 23. That is, the non-contact thermometer 89 is a temperature sensor for measuring the temperature of the non-contact area of the film 22 with the heater 23. Specifically, the non-contact thermometer 89 measures the temperature on the surface that is to be in contact with the film 22 at the position (the point S in FIG. 2) inclined by $\tau^\circ$ 30° in the present embodiment) along the surface of the film 22 from the fixing nip portion. In the present embodiment, since the non-contact area of the film 22 with the heater 23 is provided outside the fixing nip portion, the temperature of the non-contact area is hereafter referred to as a temperature outside the nip. Further, the temperature difference between the temperature inside the nip and the temperature outside the nip is referred to as a temperature difference between inside the nip and outside the nip.

Figure 3A:
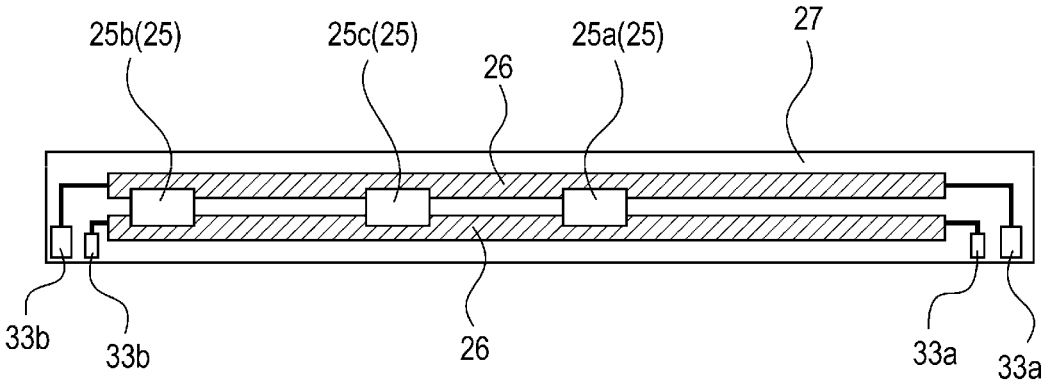
FIGS. 3A and 3B are diagrams showing a plan view of a heater substrate.
Figure 3B:
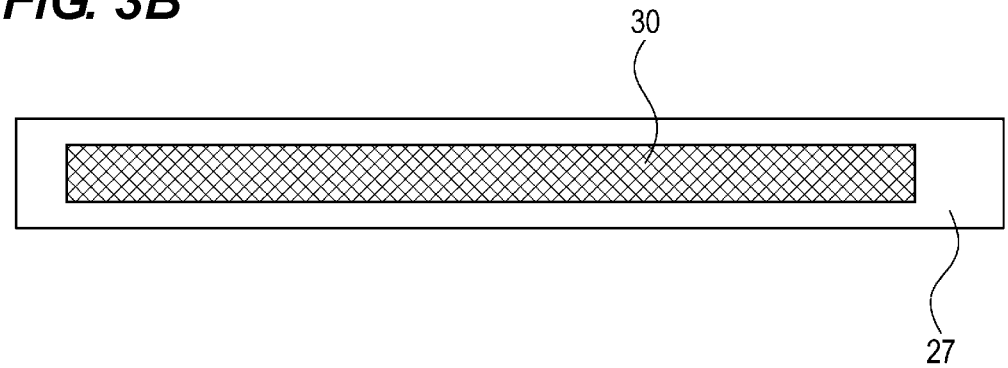

FIGS. 3A and 3B are views showing the configuration of the heater substrate 27. FIG. 3A shows the configuration on the surface side facing the guide member 21 and FIG. 3B shows the surface side that is to be in contact surface with the film 22. As shown in FIGS. 3A and 3B, two heating resistors 26 are arranged in parallel with each other on the surface of the heater substrate 27 facing the guide member 21. In addition, a power feeding portion 33 (33*a*, 33*b*) is provided on the surface to feed power to the heating resistors 26.

Three thermistors 25 are provided in the longitudinal direction on the side of the heater substrate 27 facing the guide member 21. The main thermistor 25*a*, which is nearest to the center in the longitudinal direction among the three thermistors 25, is disposed in the region through which the sheet P with a minimum width size passes in the sheet width direction orthogonal to the conveying direction of the sheet P. Namely, the sheet P with any width passes through this region without fail. The first sub-thermistor 25*b* is disposed in the non-passing region in the sheet width direction through which the sheet P with A4-size does not pass when the sheet P with A4-size is conveyed in the R direction. On the other hand, the second sub-thermistor 25*c* is disposed in the non-passing region in the sheet width direction through which the sheet P with B5-size does not pass when the sheet P with B5-size is conveyed in the R direction.

Then, the temperature of the passing region of the sheet P is detected by the main thermistor 25*a*, and the temperature of the non-passage region at the time of passing through the small size sheets such as A4R, B5R, or the like, is detected by the sub thermistors 25*b* and 25*c*. As a result, an abnormal temperature rise in the non-passage area is prevented from occurring when small size sheets continuously pass through the fixing nip portion.

On the heater substrate 27, a thermo-switch 32 (see FIG. 5) is disposed at a position symmetrical to the main thermistor 25*a* with respect to the center portion in the longitudinal direction. The thermo-switch 32 is a switch that functions as a safety device when the heater 23 is excessively heated due to a malfunction of the thermistor 25 or failure of the control portion. A bimetal is built in the thermo-switch 32. When the bimetal reaches a predetermined temperature, the bimetal is deformed, thereby interrupting the energization to the heating resistor 26.

Control Portion

Next, the configuration of the control portion of the image forming apparatus A, particularly the parts of the configuration related to the control of the fixing device 11, will be described.

FIG. 4 is a block diagram showing the configuration of a part of the control portion of the image forming apparatus A. As shown in FIG. 4, the control portion includes the CPU 80 (control portion, setting portion), a random-access memory (RAM) 81, and a read only memory (ROM) 82. Further, the heater 23, an operation portion 83, an environment sensor 88 (environment detecting portion), a non-contact thermometer 89, the fixing motor 86, and the like, are connected to the CPU 80.

The ROM 82 stores various programs, such as a temperature control program and a power supply control program, fixing temperature information, and the like. Further, the CPU 80 performs various arithmetic processing based on the program stored in the ROM 82. The RAM 81 is used as a working area in the arithmetic processing of the CPU 80.

The operation portion 83 outputs to the CPU 80 an operation instruction from the outside input by a user, or the like. The fixing motor 86 rotates the pressure roller 24 under the control of the CPU 80.

The environment sensor 88 is disposed in the main body of the image forming apparatus A, and detects the atmospheric temperature (internal temperature) of the image forming apparatus A and outputs the detected temperature to the CPU 80. The non-contact thermometer 89 detects the temperature outside the nip of the film 22 and outputs the detected temperature to the CPU 80. The thermistors 25 detect the temperature of the heater 23 and the temperature inside the nip of the film 22 based on the temperature of the heater 23 and outputs the detected temperatures to the CPU 80. The CPU 80 controls the temperature of the heater 23 and driving of the fixing motor 86 based on the temperature information, and the like, which will be described later.

Next, the energization control of the heater 23 at the time of image formation will be described.

Figure 5:
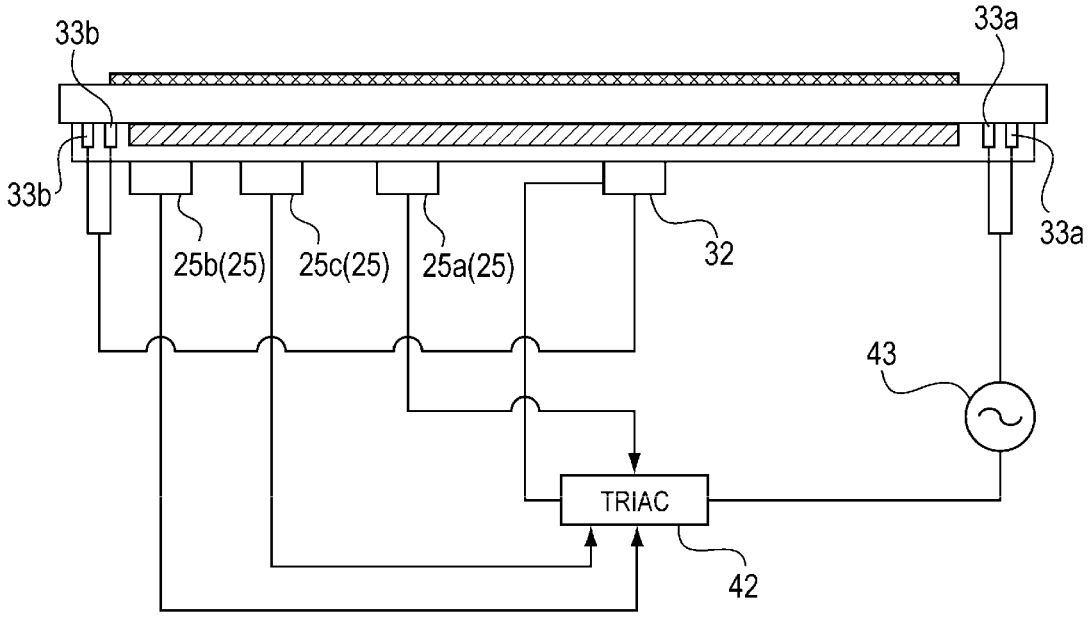
FIG. 5 is a circuit diagram showing energization control paths of a heater.

FIG. 5 is a diagram showing energization control paths of the heater 23. As shown in FIG. 5, when the CPU 80 receives an image forming job signal, the CPU 80 turns on a triac 42, thereby energizing the heating resistor 26 from an alternating current (AC) power supply 43 via the power supplying portions 33*a*, 33*b* and the thermo-switch 32.

As a result of this energization, the heating resistor 26 entirely generates heat so that the temperature rises. The temperature of the heater substrate 27, which is heated in accordance with this temperature rise, is detected by analog/digital (A/D) converting the output of the thermistors 25. The energization continues until the temperature of the heater substrate 27, that is, the temperature of the heater 23, reaches a target temperature.

That is, when the heater 23 reaches the target temperature, the electrical power to be supplied to the heater 23 is controlled by the triac 42 based on the output signal from the thermistors 25 using a phase control, a frequency control, or the like, to control the temperature of the heater 23. Specifically, the CPU 80 controls the triac 42 such that the CPU 80 raises the temperature of the heating resistor 26 when the temperature detected by the thermistors 25 is less than the set temperature and lowers the temperature of the heating resistor 26 when the temperature is greater than the set temperature to keep the temperature of the heater 23 at the set temperature. When the image forming operation is finished, the triac 42 is turned off and energization to the heater 23 is terminated.

Experiment of Occurrence of Film Dent Mark

Next, the result of the experiment of occurrence of the dent mark of the film 22 will be described.

As described above, the dent mark of the film 22 is generated due to the application of the driving force to the film 22 after the distortion is generated by the thermal stress in the film 22 due to a temperature difference in the rotation direction (circumferential direction) of the film 22. In this experiment, the strain amount of the film 22 at the fixing nip portion was measured when the temperature difference between inside the nip and outside the nip of the film 22 was changed between 80° C. and 100° C. in a state in which the film 22 and the pressure roller 24 were stopped. Thereafter, the pressure roller 24 was driven to rotate the film 22, and it was confirmed whether or not there was a dent mark on the film 22.

Figure 27A:
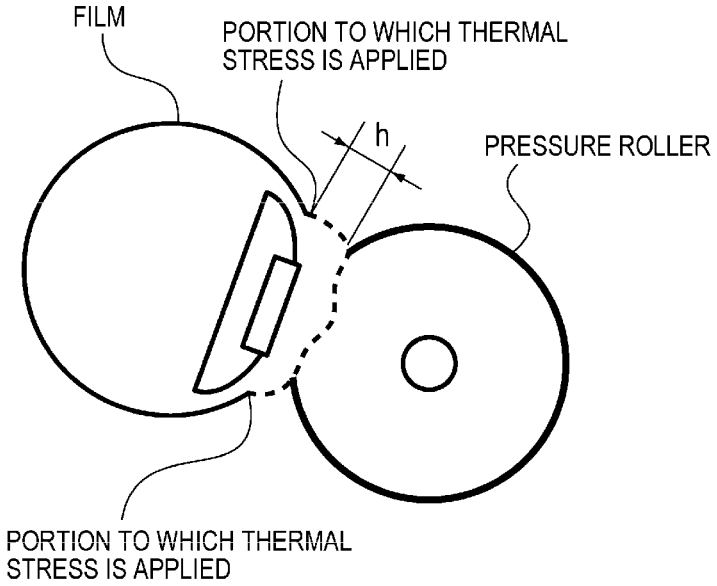
FIGS. 27A and 27B are schematic diagrams of a film and a pressure roller for explaining a conventional problem.
Figure 27B:
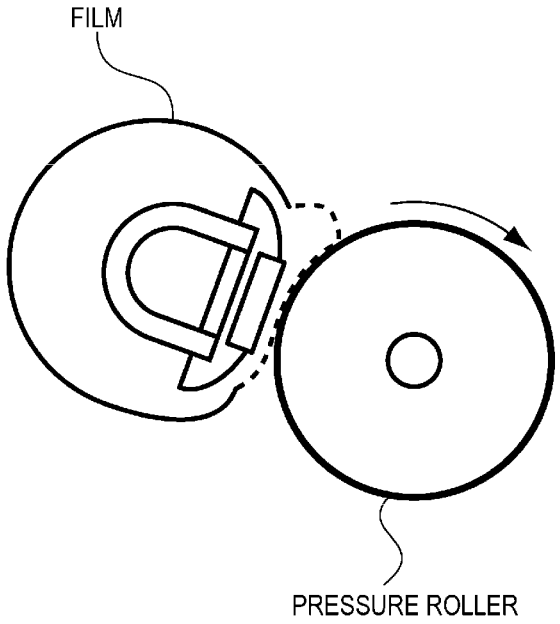

As the temperature inside the nip, the temperature at the substantially central portion of the fixing nip portion in the sheet conveying direction on the contact surface of the film 22 with the sheet P was measured. As the temperature outside the nip, the temperature at the position (the point S in FIG. 2) in which non-contact thermometer described above was disposed on the contact surface of the film 22 with the sheet P was measured. As the amount of strain, the amount of a change in the shape of the film 22 before and after the heating (the length of the arrow h shown in FIG. 27A) was measured.

FIG. 6 shows the experiment results. As shown in FIG. 6, it was confirmed in this experiment that when the temperature difference between inside the nip and outside the nip of the film 22 became 95° C. or more, the amount of strain became 50 μm or more and then a dent mark was formed on the film 22 by rotating the film 22 thereafter. Therefore, the control, which will be described later, is performed in which the temperature difference between inside the nip and outside the nip of the film 22 becomes less than 95° C. to suppress the deformation (occurrence of a dent mark) of the film 22.

Startup Control

First, a start-up control that raises the temperature of the heater 23 to the set temperature when an image forming job signal is received will be described with reference to the flowchart shown in FIG. 7. In the present embodiment, the temperature at which the lubricant applied between the polyimide coating 30 of the heater 23 and the film 22 starts melting and the lubricity can be secured is 80° C.

Figure 7:
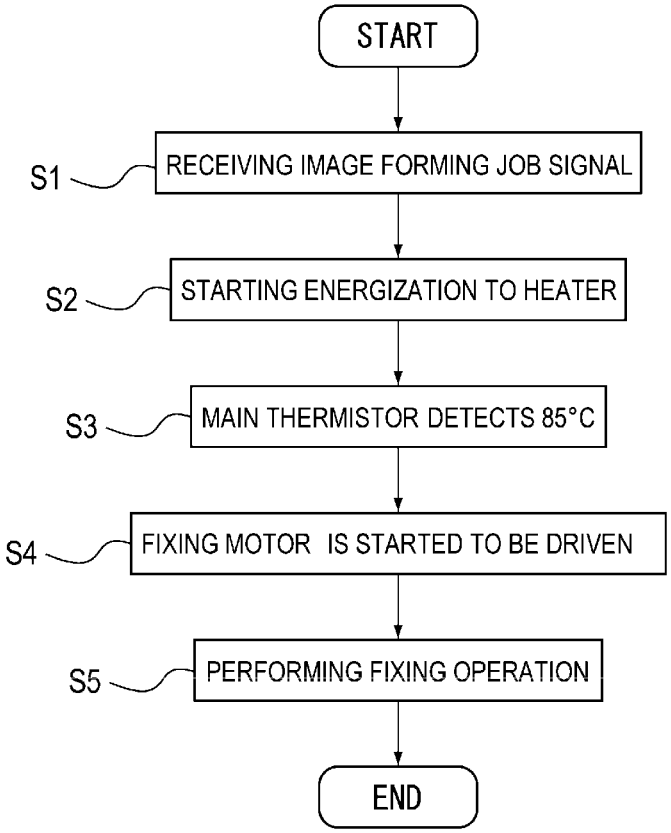
FIG. 7 is a flowchart of a start-up control.

As shown in FIG. 7, when receiving a job signal for forming an image (S1), the energization to the heater 23 is started (S2) while the film 22 is stopped. Next, when the temperature of the heater 23 detected by the main thermistor 25*a* reaches 85° C. (S3), the fixing motor 86 is started to be driven (S4), and the pressure roller 24 is rotated to rotate the film 22. That is, the CPU 80 acquires the result of the temperature of the heater 23 detected by the main thermistor 25*a* and starts driving of the fixing motor 86 when the temperature of the heater 23 reaches 85° C. Thereafter, when the heater 23 reaches the set temperature, a fixing operation is performed while the sheet P passes through the fixing nip portion (S5).

Figure 8:
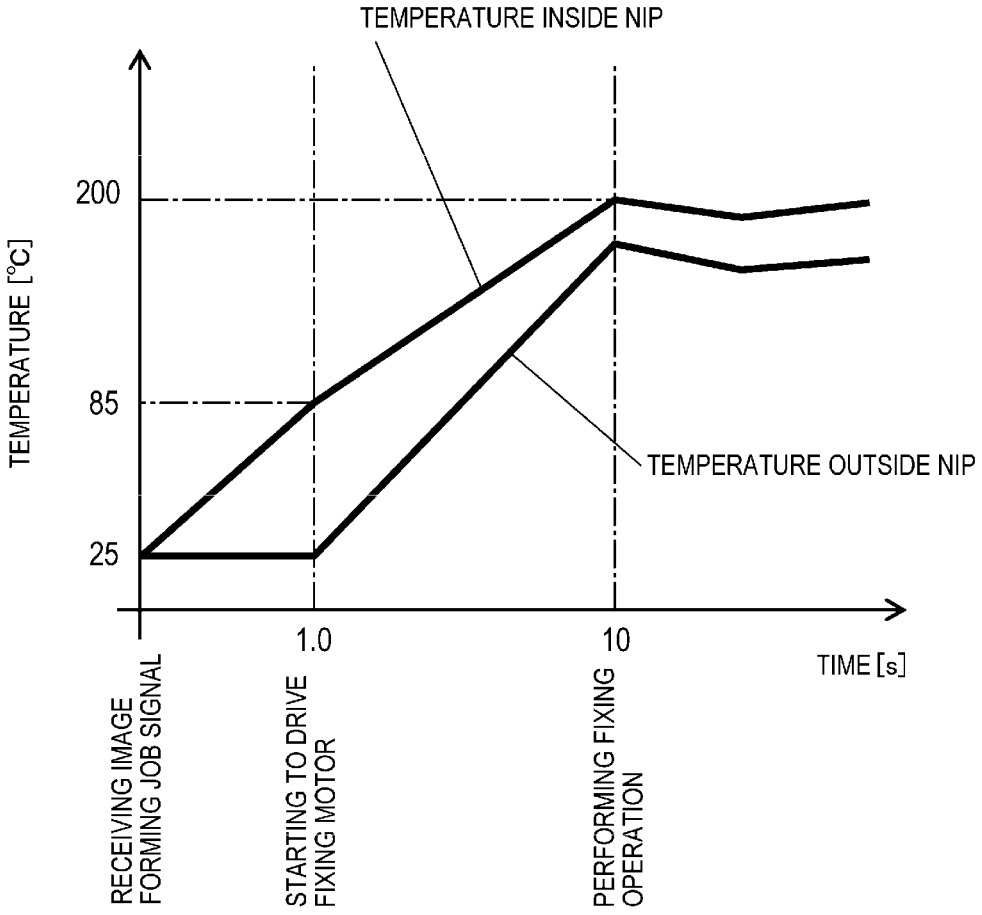
FIG. 8 is a graph showing transitions of temperatures inside the nip and outside the nip of the film when the start-up control is performed.

FIG. 8 is a graph showing transitions of temperature inside the nip and the temperature outside the nip of the film 22 when the start-up control is performed under the environment of 25° C. As shown in FIG. 8, upon receiving an image forming job signal, the film 22 is stopped and heated. As a result, the temperature inside the nip of the film 22 rises. At this time, since the film 22 is in a non-rotating state, the temperature outside the nip does not rise while keeping the ambient temperature.

Next, when the temperature of the heater 23 rises to 85° C., the fixing motor 86 is started to be driven and the film 22 rotates. As a result, the temperature outside the nip of the film 22 rises. In this case, when the detected temperature of the thermistor reaches 210° C., the fixing operation is performed, and the temperature inside the nip is around 200° C. at this time.

By performing such a control, even in a low temperature environment, such as, for example, a 0° C. environment, the temperature difference between inside the nip and outside the nip of the film 22 is 85−0=85° C., which means that the temperature difference between inside nip and outside the nip can be suppressed within 95° C. Namely, by starting the rotation of the film 22 when the temperature difference between inside the nip and outside of the nip of the film 22 is less than or equal to a predetermined value in the start-up control, the temperature difference in the rotation direction of the film 22 can be suppressed to a predetermined value or less when the film 22 is rotated. Therefore, it is possible to reduce the friction between the film 22 and the heater 23 at the start of driving by melting the lubricant while suppressing the occurrence of a dent mark on the film 22.

In the present embodiment, the control to start the driving of the fixing motor 86 is performed when the detected temperature of the main thermistor 25*a* becomes 85° C., but the present invention is not limited thereto. Namely, the same effect as described above can be obtained if the control is performed such that the film 22 is rotated in the temperature range capable of preventing an occurrence of a dent mark on the film 22 at the time when the film 22 is to be rotated while securing the lubricity of the lubricant applied between the film 22 and the heater 23.

Post-Rotation Control

Next, the post-rotation control performed after the fixing operation will be described.

When the rotation of the pressure roller 24 and the film 22 are stopped immediately after the end of the fixing operation, there is a possibility that both of them are stuck to each other at the fixing nip portion since both of them are high in temperature. When the rotation is started again in the state in which both of them are stuck to each other, the fluorine coat, the fluorine tube, or the like, on the surface layer of the film 22 peels off and the toner adheres to the pressure roller 24 and the film 22, so that image contamination occurs.

In addition, a charge-up may occur in which the pressure roller 24 is charged due to friction with the sheet P during the fixing operation. When the pressure roller 24 is charged up with the same polarity as that of the toner, the toner adheres to the film 22 and the sheet P whose toner image is to be fixed next becomes contaminated.

Then, the post-rotation control is performed in which the pressure roller 24 and the film 22 are rotated to cool both of them and the electricity from the pressure roller 24 is removed after the fixing operation.

First, the conventional post-rotation control will be described. Conventionally, after completion of the fixing operation, the energization to the heater 23 is turned off and only the rotation control is performed to cool the film 22 and the pressure roller 24. The time for performing the rotation control is set to 20 seconds when the basis weight of the sheet P to be fixed is large, and is set to 2.5 seconds when the basis weight is small. This is because the electrical resistance of the sheet P increases so that the pressure roller 24 is more easily charged up by friction with the sheet P as the basis weight increases. Therefore, when the basis weight of the sheet P is large, the control is performed such that the post-rotation time increases, so that the film 22 having conductivity greater than the sheet P is brought into contact with the pressure roller 24 for a longer time to sufficiently remove electricity.

Next, the post-rotation control of the present embodiment will be described with reference to the flowchart shown in FIG. 9.

Figure 9:
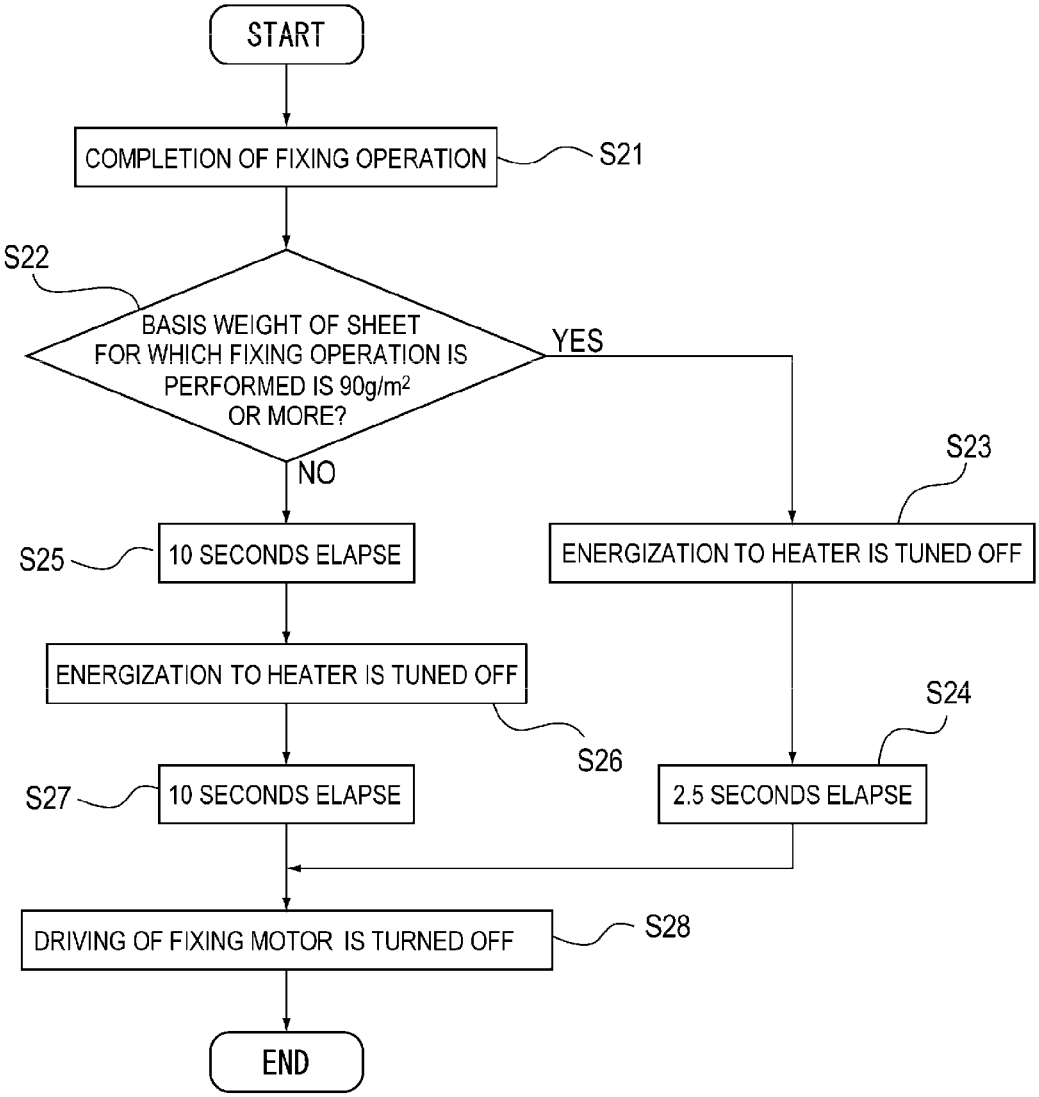
FIG. 9 is a flowchart of a post-rotation control.

As shown in FIG. 9, after completion of the fixing operation (S21), it is determined whether or not the basis weight of the sheet P for which the fixing operation is performed, that is, the basis weight of the sheet P on which the toner image is fixed, is equal to or greater than a predetermined value (S22). In the present embodiment, it is determined whether or not the basis weight of the sheet P is 90 g/m$^2$ or more. The basis weight of the sheet P is read based on the type of the sheet P set by a user on the operation portion 83 (see FIG. 4).

If the basis weight of the sheet P is less than 90 g/m$^2$, the energization of the heater 23 is turned off (S23), the pressure roller 24 and the film 22 are rotated for 2.5 seconds (S24).

Thereafter, the driving of the fixing motor 86 is turned off (S28), thereby terminating the post-rotation control.

On the other hand, when the basis weight of the sheet P is 90 g/m$^2$ or more, the pressure roller 24 and the film 22 are rotated for 20 seconds in the same manner as in the conventional apparatus in order to remove electricity of the pressure roller 24. At this time, in the first 10 seconds, the pressure roller 24 and the film 22 are rotated in the state in which energization of the heater 23 is continued (S25). The temperature of the heater 23 at this time is controlled to the regulated temperature during the fixing operation.

Thereafter, the energization of the heater 23 is turned off (S26), and the pressure roller 24 and the film 22 are rotated for 10 seconds (S27). Thereafter, the driving of the fixing motor 86 is turned off (S28), thereby terminating the post-rotation control.

Discharge Control

Next, the discharge control for cleaning the pressure roller 24 after the completion of the post-rotation control will be described.

In the discharge control, the film 22 is heated by increasing the temperature of the heater 23 until the temperature of the film 22 becomes equal to or greater than the softening point of the toner in the state in which the fixing motor 86 is stopped, thereby transferring the toner on the pressure roller 24 to the film 22 to clean the pressure roller 24. As a result, in the next fixing operation, the toner is gradually transferred from the film 22 to the surface of the sheet P. By repeating this operation, accumulation of toner on the pressure roller 24 is prevented, and conspicuous toner contamination on the back surface of the sheet P is suppressed.

First, the conventional discharge control will be described. In the conventional control, when the driving of the fixing motor 86 is turned off after the completion of the post-rotation control, first, the energization to the heater 23 is started. Thereafter, the energization is continued until the main thermistor 25*a* detects 190° C. After reaching 190° C., proportional integral (PI) control is performed for controlling the temperature at 190° C. using the main thermistor 25*a*. Then, after 5 seconds have elapsed since the heater 23 detected 190° C., the energization to the heater 23 is turned off. As a result, the toner on the pressure roller 24 is transferred to the film 22.

Next, the discharge control of the present embodiment will be described with reference to the flowchart shown in FIG. 10. In this embodiment, it is assumed that the softening point of the toner is 160° C.

Figure 10:
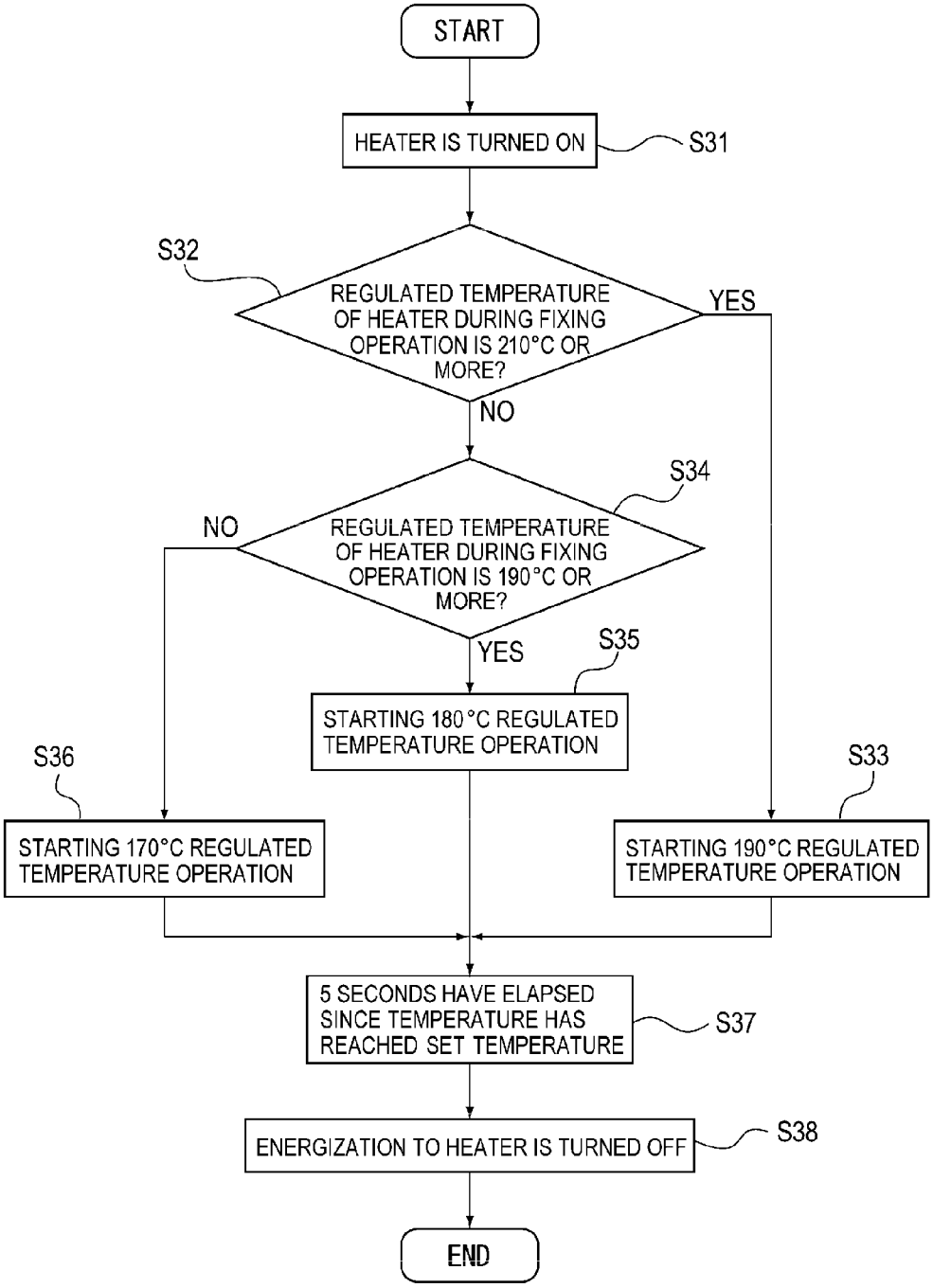
FIG. 10 is a flowchart of a discharge control.

As shown in FIG. 10, when the fixing motor 86 is first turned off and the post-rotation control is completed, the energization to the heater 23 is turned on and the discharge control is started (S31).

Next, when the regulated temperature of the heater 23 during the fixing operation is 210° C. or more (the first temperature), the regulated temperature of the heater 23 during the discharge control is set to 190° C. (the second temperature) (S32, S33). On the other hand, when the regulated temperature of the heater 23 during the fixing operation is 190° C. or more and less than 210° C. (third temperature), the regulated temperature during the discharge control is set to 180° C. (fourth temperature) (S24, S35). When the regulated temperature of the heater 23 is less than 190° C., the regulated temperature at the discharge control is set to 170° C. (S34, S36). In the present embodiment, the regulated temperature of the heater 23 is set to be greater in order to secure the fixing property for the sheet P with a greater basis weight and is set to be lower in order to prevent hot offset of the toner for the sheet P with a smaller basis weight. For example, the user may input the basis weight of the sheet through the operation unit 83. When the basis weight of the sheet is set by the user, the regulated temperature of the heater 23 at the time of the fixing operation is determined according to the sheet.

Next, after 5 seconds have elapsed since the temperature has reached the determined regulated temperature (S37), the heater 23 is turned off (S38), thereby terminating the discharge control to enter the fixing standby state.

Figure 11A:
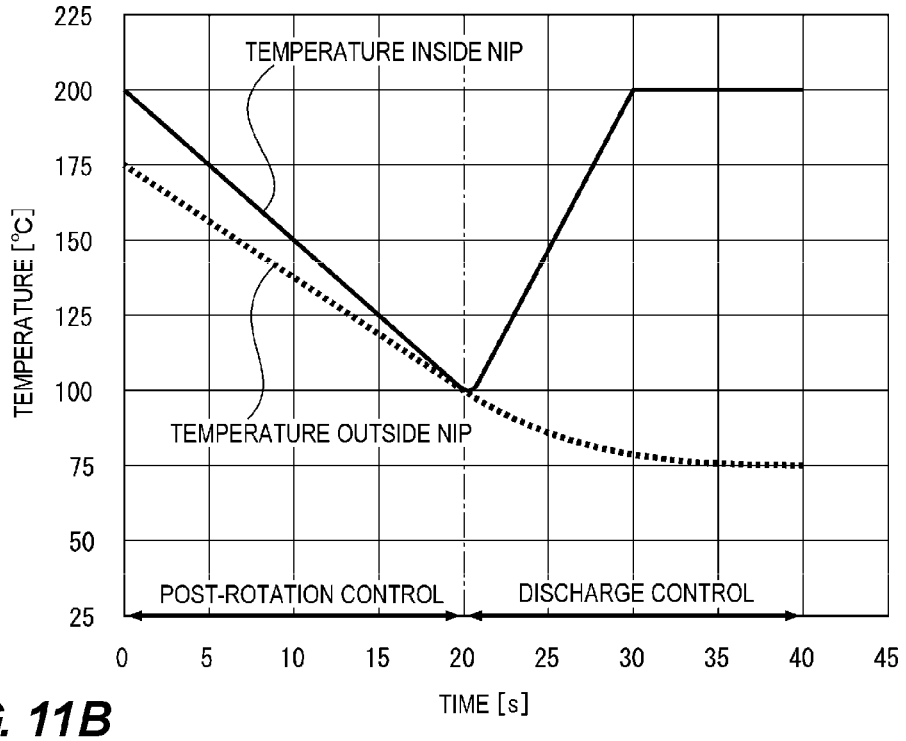
FIGS. 11A and 11B are graphs showing a transition of a temperature inside the nip and outside the nip of a film when the post-rotation control is performed.
Figure 11B:
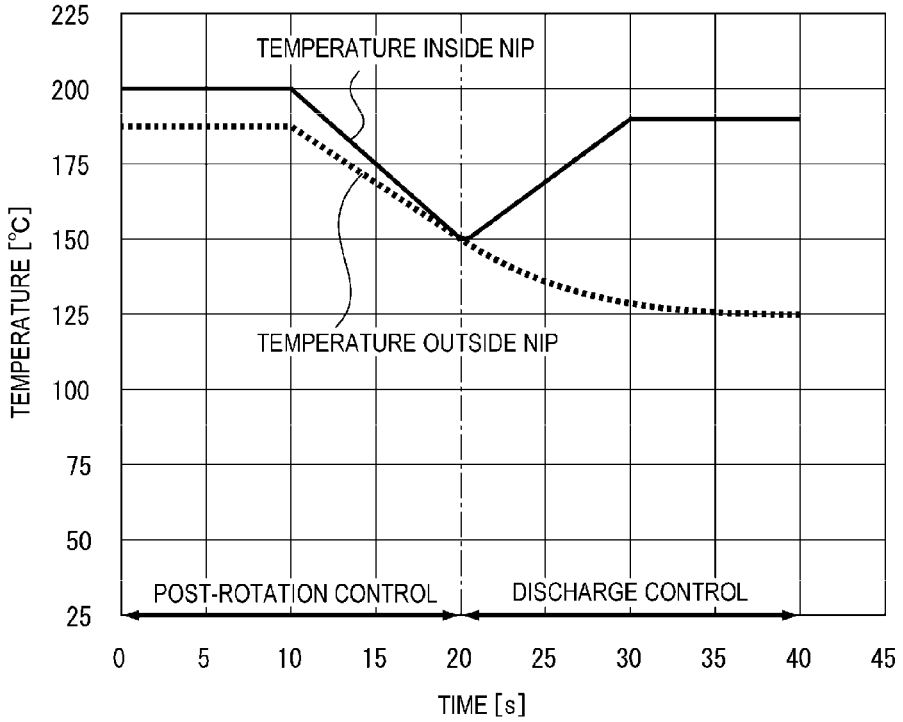

FIGS. 11A and 11B are graphs showing transitions of temperatures inside the nip and outside the nip of the film 22 when the discharge control described above is performed after the post-rotation control. FIG. 11A shows temperature transitions when the conventional post-rotation control is performed. FIG. 11B shows temperature transitions when the post-rotation control of the present embodiment is performed. These graphs show temperature transitions after the fixing operation has been performed at the regulated temperature of 210° C. for five sheets P with the basis weight of 100 g/m$^2$ under the low temperature environment of 0° C. Also, in these graphs, the time point of 0 second is the point at which the post-rotation control starts after the completion of the fixing operation.

As shown in FIGS. 11A and 11B, in the conventional control, both the temperature inside the nip and the temperature outside the nip decrease and the difference between the temperature inside the nip and the temperature outside the nip becomes smaller since the energization to the heater 23 is interrupted at the start of the post-rotation control. Thereafter, when the heating in the halt state is performed during the discharge control, although the temperature inside the nip of the film 22 rises sharply, the temperature outside the nip continuously decreases. Therefore, when the temperature difference between inside the nip and outside the nip becomes large during the discharge control and the fixing motor 86 is driven by receiving an image forming job during the subsequent discharge control and immediately after the discharge control, a dent mark is generated on the film 22.

On the other hand, in the control according to the present embodiment, since the rotation is performed while energizing the heater 23 for the first 10 seconds even after the start of the post-rotation control, the temperature inside the nip and outside the nip of the film 22 becomes greater at the end of the post-rotation control than that by the conventional control. Therefore, even if the heating in the halt state is performed by the discharge control thereafter, the temperature difference between inside the nip and outside the nip of the film 22 becomes less than 95° C. At this time, even when the fixing motor 86 is driven, an occurrence of a dent mark on the film 22 is suppressed.

In this manner, by continuing the energization instead of immediately turning off the energization of the heater 23 in the post-rotation control, it is possible to increase the temperature inside the nip of the film 22 at the end of the post-rotation control. Further, it is possible to reduce the temperature difference between inside the nip and outside the nip even when the heating in the halt state is performed thereafter. Namely, by controlling the temperature of the heater 23 so that the temperature difference between inside the nip and outside the nip of the film 22 becomes less at the time of non-rotation period of the film 22, even if the fixing motor 86 is turned on thereafter, generation of a dent mark on the film 22 can be suppressed.

Since the film 22 and the pressure roller 24 are cooled without energizing the heater 23 in the second 10 seconds, it is possible to prevent sticking between the film 22 and the pressure roller 24. Further, even if the rotation is performed while the heater 23 is energized, the electrical resistances of the surface of the film 22 and the surface of the pressure roller 24 do not change greatly, so the effect of the pressure roller 24 for removing electricity does not change and it is possible to prevent toner contamination caused by the charge-up of the pressure roller 24.

Figure 12A:
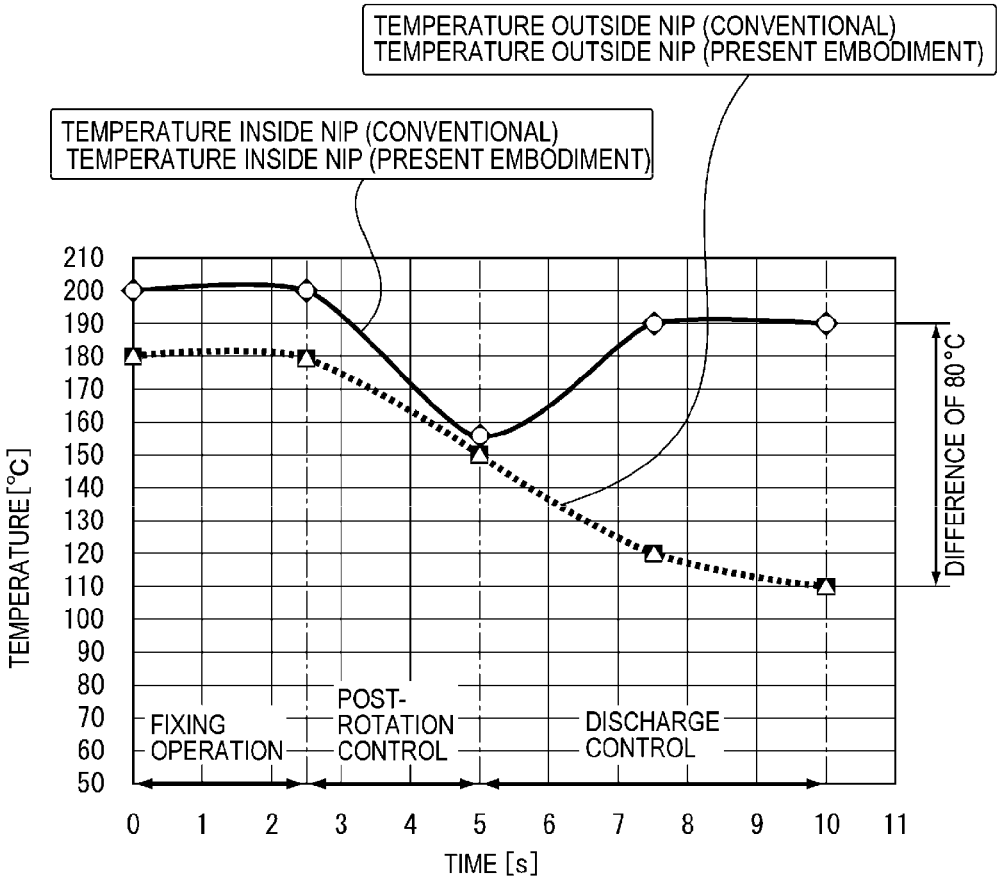
FIGS. 12A and 12B are graphs showing transitions of temperatures inside the nip and outside the nip of a film when the discharge control is performed.
Figure 12B:
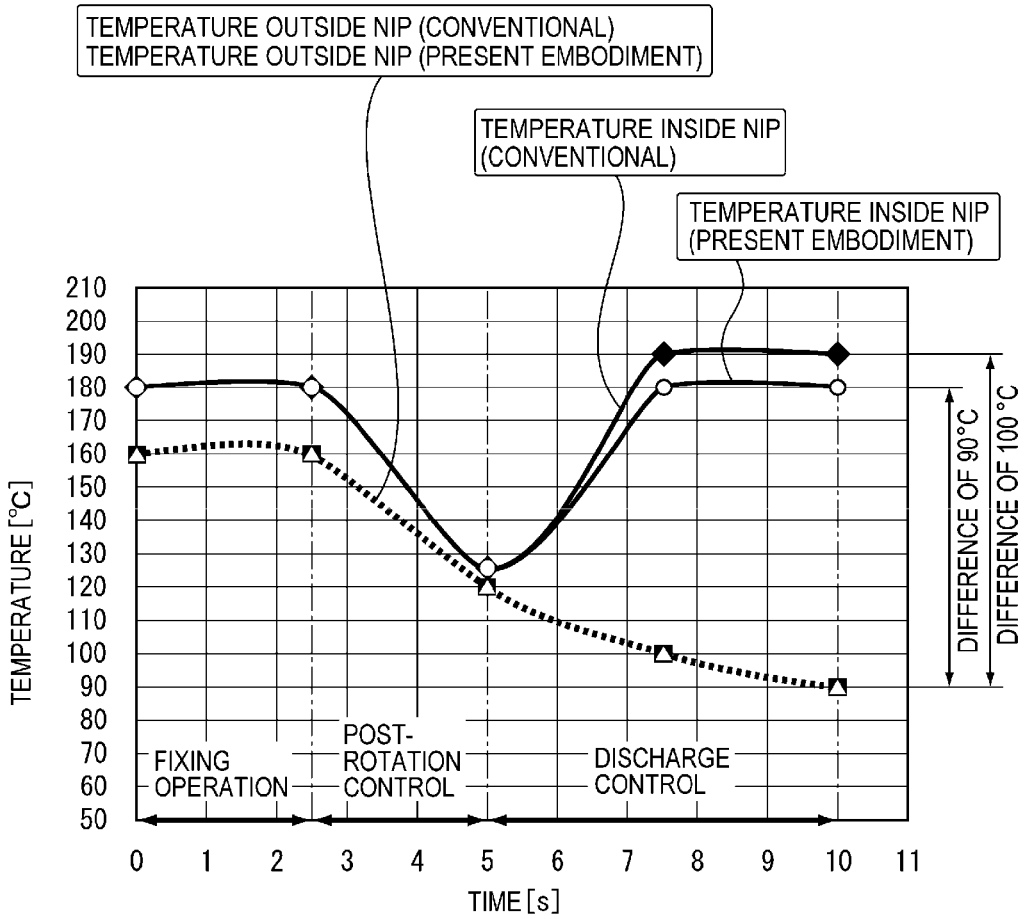

FIGS. 12A and 12B are graphs showing the transitions of temperatures inside the nip and outside the nip of the film 22 during the fixing operation, the post-rotation control and the discharge control when the basis weight of the sheet P for which the fixing operation is performed and the set regulated temperature during the fixing operation are changed under the 0° C. environment. FIG. 12A shows temperature transitions when the conventional discharge control and the discharge control of the present embodiment were performed in the condition that the basis weight of the sheet P for which the fixing operation is performed is 80 g/m$^2$ and set regulated temperature for the heater 23 at the time of the fixing operation is 210° C.

FIG. 12B shows temperature transitions when the conventional discharge control and the discharge control of the present embodiment were performed in the condition that the basis weight of the sheet P for which the fixing operation is performed is 60 g/m$^2$ and the set regulated temperature for the heater 23 at the time of the fixing operation is 190° C.

As shown in FIG. 12A, when the basis weight of the sheet P for which the fixing operation is performed is 80 g/m$^2$, the regulated temperature at the time of discharge control in both the present embodiment and the conventional control is 190° C. Therefore, the temperature transitions of the control according to the present embodiment are equivalent to those of the conventional control. Specifically, the temperatures inside the nip and outside the nip of the film 22 decrease during the post-rotation operation after the fixing operation has been completed. After that, the discharge control is started and the temperature inside the nip of the film 22 increases until the regulated temperature is controlled to 190° C. On the other hand, since the temperature outside the nip continues to decrease during the discharge control, the temperature difference inside the nip and outside the nip of the film 22 at the end of the discharge control is 80° C. At this time, since the temperature difference between the inside the nip and outside of the nip is within 95° C., even if the pressure roller 24 is driven to rotate the film 22 in this state, a dent mark does not occur on the film 22.

On the other hand, as shown in FIG. 12B, when the basis weight of the sheet for which the fixing operation is performed is 60 g/m$^2$ and the set regulated temperature of the heater 23 at the time of the fixing operation is 190° C., since the regulated temperature is less than that in the case in which the basis weight of 80 g/m$^2$, the amount of heat stored in the film 22 during the fixing operation is small. For this reason, the temperature of the film 22 at the end of the post-rotation control is low as a whole. In this case, in the conventional control, when the temperature inside the nip of the film 22 increases after the start of the discharge control and the regulated temperature is controlled to 190° C., the temperature difference between inside the nip and outside the nip of the film 22 at the end of the discharge control becomes 100° C. Therefore, when the driving of the motor is started at the end of the discharge control, since the temperature difference is greater than 95° C., a dent mark occurs on the film 22.

On the other hand, in the control of the present embodiment, the temperature outside the nip of the film 22 shows a transition equivalent to the conventional control. The regulated temperature of the heater 23, however, at the time of discharge control changes to 180° C. according to the regulated temperature at the time of the fixing operation. Therefore, the temperature difference between inside the nip and outside the nip of the film 22 at the end of the discharge control is 90° C. As a result, no dent mark occurs on the film 22 even when the driving of the motor is started at the end of the discharge control.

In this manner, the regulated temperature of the heater 23 at the time of discharge control is changed based on the regulated temperature of the heater 23 at the time of the fixing operation so that the temperature difference between inside the nip and outside the nip of the film 22 at the time of discharge control is made small. That is, when the film 22 is not rotating, the temperature of the heater 23 is controlled so that the temperature difference between an inside and an outside of the nip is equal to or less than a predetermined value. As a result, it is possible to suppress the occurrence of a dent mark on the film 22 even when the motor is driven after receiving an image forming job thereafter.

In the present embodiment, a configuration has been described in which the heater 23 is used as the heating unit. The present invention is not, however, limited thereto. For example, instead of using the heater 23 as a heating unit, an induction heating (IH) coil opposed to the film 22 may be provided for heating the film 22.

Second Embodiment

Next, the second embodiment of the image forming apparatus A including the fixing device 11 according to the present invention will be described with reference to the drawings. The same parts as those of the first embodiment are denoted by the same reference numerals using the same figures, and the description thereof will be omitted.

In the first embodiment, in the start-up control, the fixing motor 86 is driven at the time when the main thermistor detects 85° C., thereby starting the rotation of the pressure roller 24 and the film 22. If the fixing operation is not performed for a long time under an extremely low temperature environment, such as −15° C. environment, however, the temperature of the film 22 decreases to about −15° C. In this case, in the control of driving the fixing motor 86 at 85° C. during the start-up control, the temperature difference between inside the nip and outside the nip of the film 22 becomes 95° C. or more, which may cause a dent mark to be generated.

Therefore, in the present embodiment, the driving start temperature of the fixing motor 86 is changed based on the detected temperature of the main thermistor 25*a*, the elapsed time since the previous image forming job is received, and the detected temperature of the environment sensor 88. The startup control according to the present embodiment will be described below with reference to the flowchart shown in FIG. 13.

Figure 13:
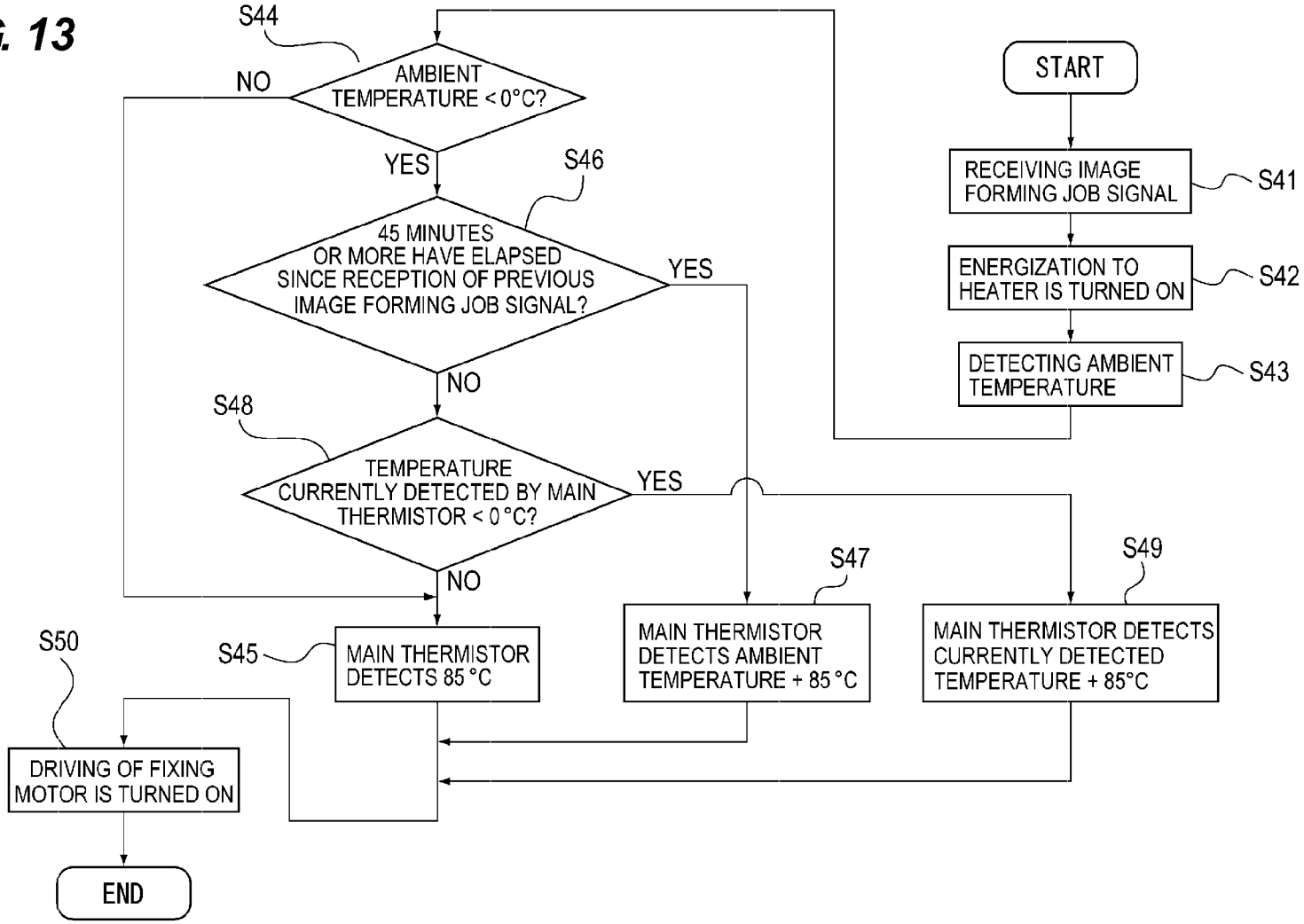
FIG. 13 is a flowchart of a start-up control.

As shown in FIG. 13, when an image forming job signal is first received (S41), energization of the heater 23 is turned on (S42). Next, the ambient temperature is detected by the environmental sensor 88 (S43). Next, it is determined whether or not the ambient temperature is less than a predetermined temperature (0° C. in the present embodiment) (S44).

When the ambient temperature is greater than 0° C., since this is not an extremely low temperature environment, the driving of the fixing motor 86 is started (S45, S50) when 85° C. is detected similarly to the control of the first embodiment.

On the other hand, when the ambient temperature is less than 0° C., it is determined whether or not 45 minutes or more have elapsed since the reception of the previous image forming job signal (S46). When 45 minutes or more have elapsed, it is considered that the temperature of the film 22 is also equal to the ambient temperature. Therefore, when the main thermistor 25*a* detects the temperature detected by the environmental sensor 88 is 85° C., the fixing motor 86 is started to be driven (S47, S50).

On the other hand, when 45 minutes or more have not elapsed, it is determined whether or not the temperature detected by the main thermistor 25*a* is less than 0° C. (S48). When the detected temperature is less than 0° C., it is considered that the temperature of the film 22 is also substantially equal to this detected temperature. Therefore, when the main thermistor 25*a* detects the detected temperature of 85° C., the drive of the fixing motor 86 is started (S49, S50).

On the other hand, when the temperature detected by the main thermistor 25*a* is equal to or greater than 0° C., the driving of the fixing motor 86 is started at the time when the main thermistor 25*a* detects a temperature of 85° C. (S45, S50).

Figure 14:
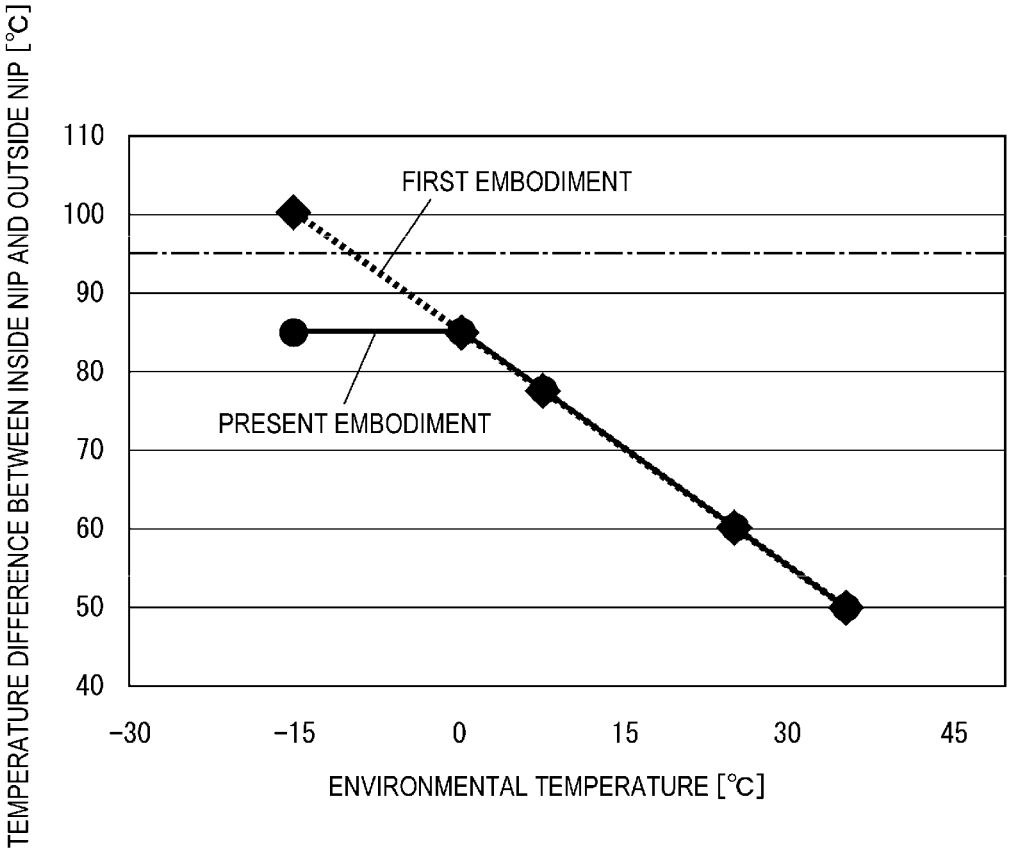
FIG. 14 is a graph showing transitions of temperatures inside the nip and outside the nip when the start-up control is performed.

FIG. 14 is a graph showing the results of measuring the temperature difference between inside the nip and outside the nip of the film 22 at the start of driving of the fixing motor 86 when the start-up control of the first embodiment and the start-up control of the present embodiment are performed under the various environments from −15° C. to 35° C. Further, the fixing device 11 is left untouched until its temperature becomes equal to the room temperature.

As shown in FIG. 14, in the control of the first embodiment, since the fixing motor 86 is driven at 85° C. even in the environment of −15° C., the temperature difference between inside the nip and outside the nip of the film 22 is 85−(−15)=100° C. and there is a possibility of generating a dent mark. On the other hand, in the control of the present embodiment, even when the fixing device 11 is placed in an extremely low temperature environment, such as −15° C. environment, the driving of the fixing motor 86 is started at the time when the main thermistor 25*a* detects 85+(−15) =70° C. Therefore, the temperature difference between inside the nip and outside the nip of the film 22 is 85° C., which is within 95° C. In this manner, by changing the driving start temperature of the fixing motor 86 during the start-up control according to the ambient temperature, it is possible to suppress the occurrence of a dent mark on the film 22.

In this embodiment, the driving of the fixing motor 86 is started when the temperature difference between inside the nip and outside the nip of the film 22 falls within a predetermined range. When the fixing motor 86 is started to be driven in the state in which the temperature difference between inside the nip and outside the nip exceeds a predetermined range, however, the fixing motor 86 may be gradually (intermittently) driven, or may be driven at a gentler acceleration and at a slower speed than at the time of image formation.

Third Embodiment

Next, the third embodiment of the image forming apparatus A including the fixing device 11 according to the present invention will be described with reference to the drawings. The same parts as those of the first embodiment and second embodiment are denoted by the same reference numerals using the same figures, and the description thereof will be omitted.

In the fixing device 11, when the sheet P for which the fixing operation is performed is thin with basis weight of 50 g/m$^2$, for example, the fixing operation is generally performed in which the regulated temperature of the heater 23 is set to be lower by the half-speed rotation in order to prevent sheet jamming, sheet winding, etc. In this case, since the regulated temperature of the heater 23 is set to be lower, the temperature of the film 22 decreases from the post-rotation control to the discharge control.

On the other hand, when the basis weight of the sheet P for which the fixing operation is performed is low, the amount of heat captured by the sheet P is relatively small, and the fixing property of the toner to the sheet P tends to be good. Therefore, the accumulation amount of the toner on the surface of the pressure roller 24 tends to be relatively small, and the necessity of performing the discharge control is low.

Therefore, in the present embodiment, it is determined whether or not the discharge control should be performed according to the regulated temperature of the heater 23 during the fixing operation. The control of the present embodiment will be described hereafter with reference to the flowchart shown in FIG. 15.

Figure 15:
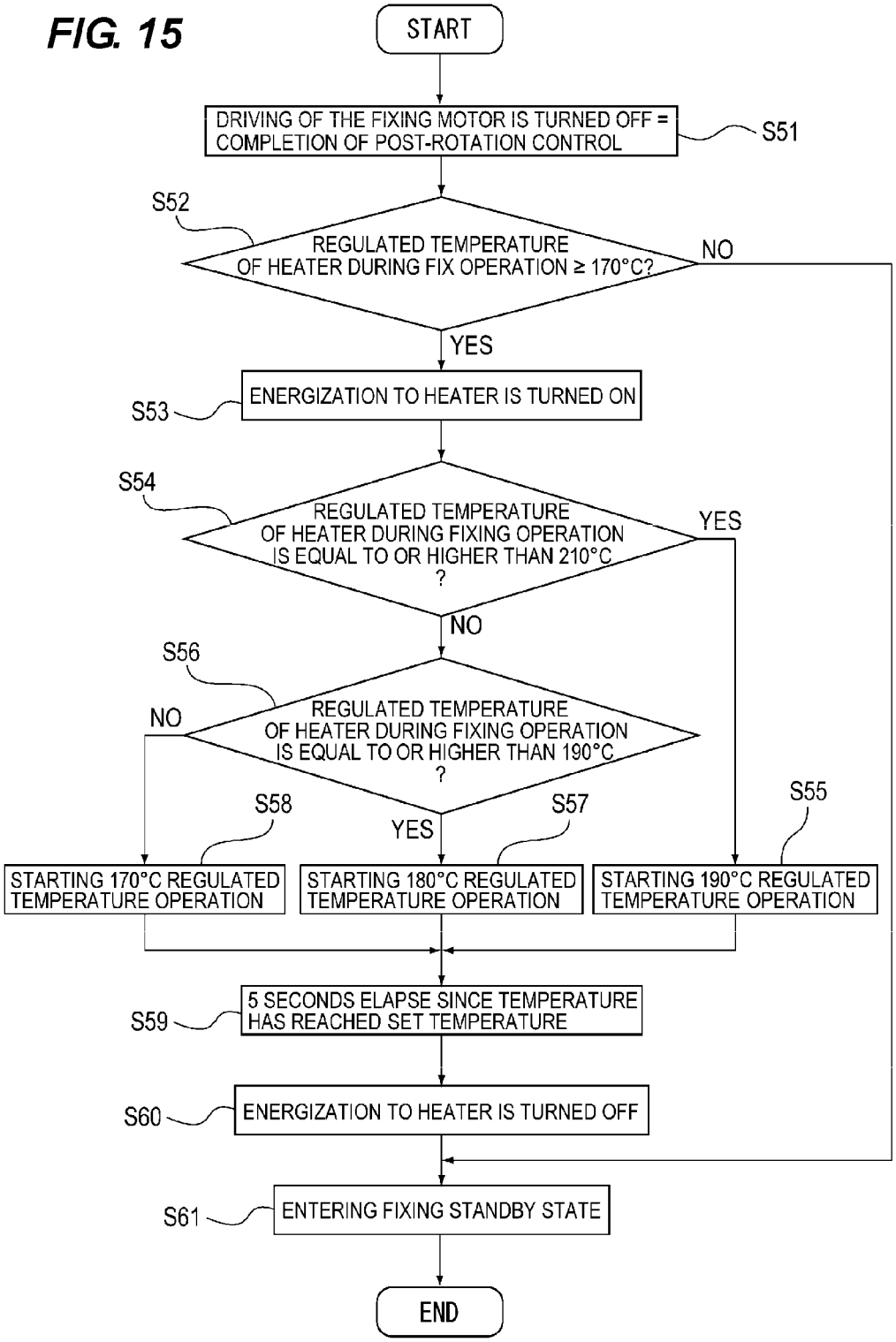
FIG. 15 is a flowchart of a fixing operation, a post-rotation control, and a discharge control.

As shown in FIG. 15, when the driving of the fixing motor 86 is turned off and the post-rotation control is finished (S51), it is determined whether or not the regulated temperature of the heater 23 during the fixing operation is equal to or greater than a predetermined value (S52). In the present embodiment, it is determined whether or not the temperature is equal to or greater than 170° C. The numerical value of 170° C. can be appropriately changed according to the environment, and the like.

When the regulated temperature of the heater 23 is less than 170° C., the necessity of the discharge control is low for the reason described above, so that the apparatus enters the fixing standby state without performing the discharge control (S61). On the other hand, when the regulated temperature of the heater 23 is equal to or greater than 170° C., the apparatus enters the fixing standby state after the discharge control similar to that in the first embodiment has been performed (S53 to S61). Namely, the CPU 80 controls the heating of the heater 23 in accordance with the heating temperature in the rotating state of the film 22 after the film 22 is stopped. Specifically, when the regulated temperature of the heater 23 in the rotating state of the film 22 is equal to or greater than 170° C. (a predetermined value or more), the heating is performed by the heater 23 after the film 22 is stopped and, when the regulated temperature of the heater 23 in the rotating state of the film 22 is less than 170° C. (less than a predetermined value), the heating by the heater 23 is not performed.

Figure 16A:
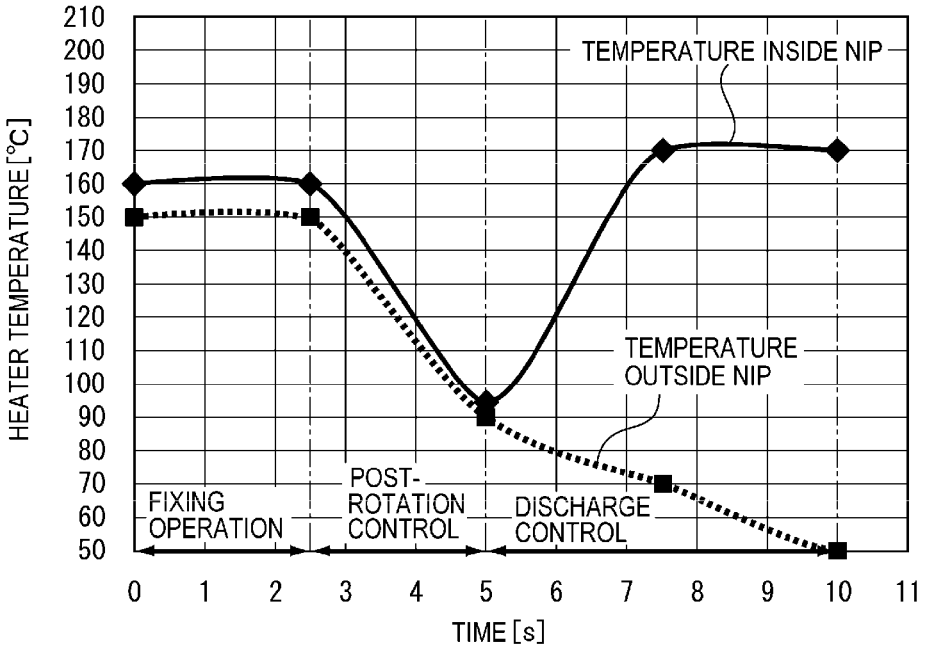
FIGS. 16A and 16B are graphs showing transitions of temperatures inside the nip and outside the nip of a film from the fixing operation to the fixing standby state.
Figure 16B:
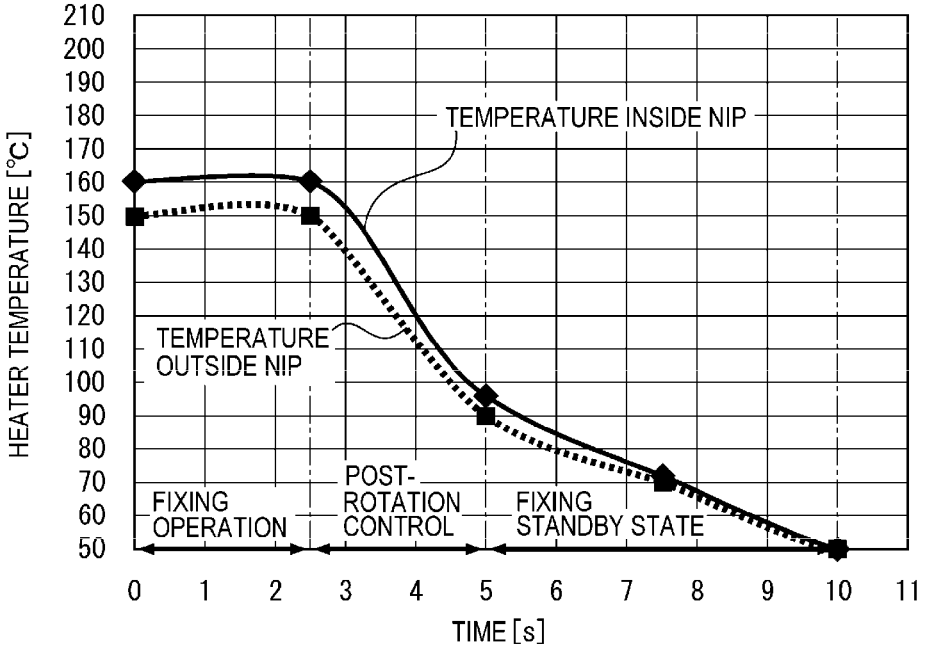

FIGS. 16A and 16B are graphs showing transitions of temperatures inside the nip and outside the nip of the film 22 from the fixing operation to the fixing standby state under a 0° C. environment when the regulated temperature is 160° C. and the sheet P for which the fixing operation is performed is of thin paper. FIG. 16A shows a temperature transition when the control of the first embodiment is performed, and FIG. 16B shows a temperature transition when the control of the present embodiment is performed.

As shown in FIG. 16A, in the control of the first embodiment, the temperature of the film 22 after the post-rotation control is low because the regulated temperature of the heater 23 during the fixing operation is as low as 160° C.

Therefore, even when the discharge control is performed at the lowest regulated temperature of 170° C., the temperature difference between inside the nip and outside the nip of the film 22 at the end of the discharge control becomes extremely high at 120° C.

On the other hand, in the control according to the present embodiment, the apparatus enters the fixing standby state without performing the discharge control when the regulated temperature is 170° C. or less. As a result, the temperature difference between inside the nip and outside the nip of the film 22 is not enlarged due to the heating in the halt state during the discharge control. Therefore, the temperature difference between inside the nip and outside the nip of the film 22 remains small even after entering the fixing standby state. Therefore, even when the fixing motor 86 is driven after receiving an image forming job signal, the temperature difference between inside the nip and outside the nip of the film 22 at the time of driving the fixing motor 86 becomes less than 95° C., so that the generation of a dent mark of the film 22 can be suppressed.

Fourth Embodiment

Next, the fourth embodiment of the image forming apparatus A including the fixing device according to the present invention will be described with reference to the drawings. The same parts as those of the first to third embodiments are denoted by the same reference numerals using the same figures, and the description thereof will be omitted.

Conventionally, when receiving an image forming job signal at the time of discharge control, the discharge control is canceled and the image forming operation is started, and, in the fixing device 11, the fixing motor 86 is driven to rotate the pressure roller 24 and the film 22. Since the heating in the halt state is performed in the discharge control, however, the temperature difference between inside the nip and outside the nip of the film 22 is large, and, when the film 22 rotates in this state, there is a possibility that a dent mark may be generated.

Therefore, in the present embodiment, when receiving an image forming job signal during the discharge control, the image forming operation is not started until the temperature difference between inside the nip and outside the nip of the film 22 becomes equal to or less than a predetermined value. The control of the present embodiment will be described below with reference to the flowchart shown in FIG. 17.

Figure 17:
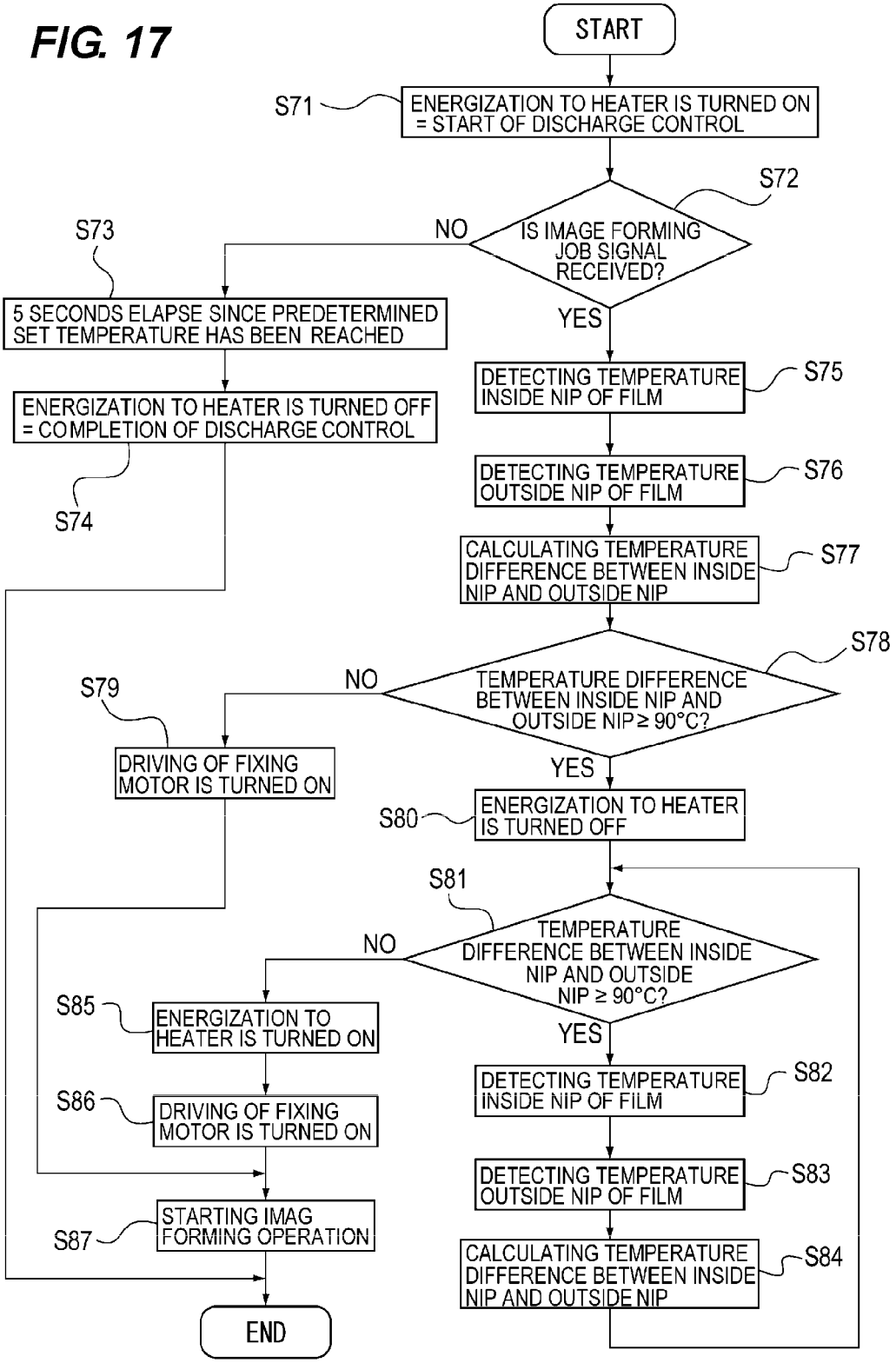
FIG. 17 is a flowchart showing a control when an image forming job signal is received during a discharge control.

As shown in FIG. 17, when the post-rotation control is completed after the fixing operation, the energization of the heater 23 is turned on while the film 22 is not rotated, and the discharge control is started (S71). Next, when an image forming job signal is not received during the discharge control, the energization of the heater 23 is turned off after 5 seconds have elapsed since the heater 23 had reached the predetermined set temperature as usual (S72 to S74), and the discharge control is completed.

On the other hand, when an image forming job signal is received during the discharge control, the temperature inside the nip and the temperature outside the nip are detected by the main thermistor 25*a* and the non-contact thermometer 89 and the temperature difference between inside the nip and outside the nip is calculated (S 72, S75, S76 and S77). Next, it is determined whether or not the temperature difference between the nip inside and outside of the film 22 is equal to or greater than a predetermined value (S78). In the present embodiment, it is determined whether or not the temperature difference between inside the nip and outside the nip of the film 22 is 90° C. or more.

When the temperature difference between inside the nip and outside the nip of the film 22 is less than 90° C., the driving of the fixing motor 86 is turned on (S79), and the image forming operation is performed (S87).

On the other hand, when the temperature difference between inside the nip and outside the nip of the film 22 is 90° C. or more, the energization of the heater 23 is turned off to perform cooling without immediately shifting to the image forming operation (S80). Thereafter, in the same manner as described above, the temperature difference inside the nip and outside the nip of the film 22 is again detected (S82 to S84), and, when it becomes 90° C. or less, the energization of the heater 23 is turned on (S85), the driving of the fixing motor 86 is turned on (S86), and the image forming operation is performed (S87).

As described above, when the CPU 80 receives a signal for driving the fixing motor 86 in the state in which the temperature difference between inside the nip and outside the nip of the film 22 is greater than or equal to a predetermined value during the discharge control, the fixing motor 86 is driven after the standby state continues until the difference between the inside and outside of the nip becomes less than the predetermined value to perform the cooling operation. Namely, when the CPU 80 receives a signal for rotating the film 22 while the film 22 is heated in the halt state with the heater 23, the CPU 80 starts the rotating operation of the film 22 when it is determined that the temperature difference between inside the nip and outside the nip is equal to or less than a predetermined value, and restricts the rotating operation of the film 22 when it is determined that the temperature difference is greater than the predetermined value. This makes it possible to reduce the temperature difference between inside the nip and outside the nip at the time of rotating the film 22, thereby suppressing the occurrence of a dent mark on the film 22.

Fifth Embodiment

Next, the fifth embodiment of the image forming apparatus A including the fixing device 11 according to the present invention will be described with reference to the drawings. The same parts as those of the first to fourth embodiments are denoted by the same reference numerals using the same figures, and the description thereof will be omitted.

Instead of measuring the temperature outside the nip of the film 22 with a non-contact thermometer (not shown), in the discharge control of the fourth embodiment, it is calculated based on an amount of change per unit time in the temperature inside the nip in the present embodiment. Namely, the detection of the temperature outside the nip of the film 22 in steps S76 and S83 described in the fourth embodiment is performed by a control described later, and the other control is the same as that in the fourth embodiment. Hereafter, the operation of calculating the temperature outside the nip of the film 22 of the present embodiment will be described with reference to the flowchart shown in FIG. 18 and a graph showing transitions of the temperature inside the nip and temperature outside the nip of the film 22 shown in FIG. 19.

Figure 18:
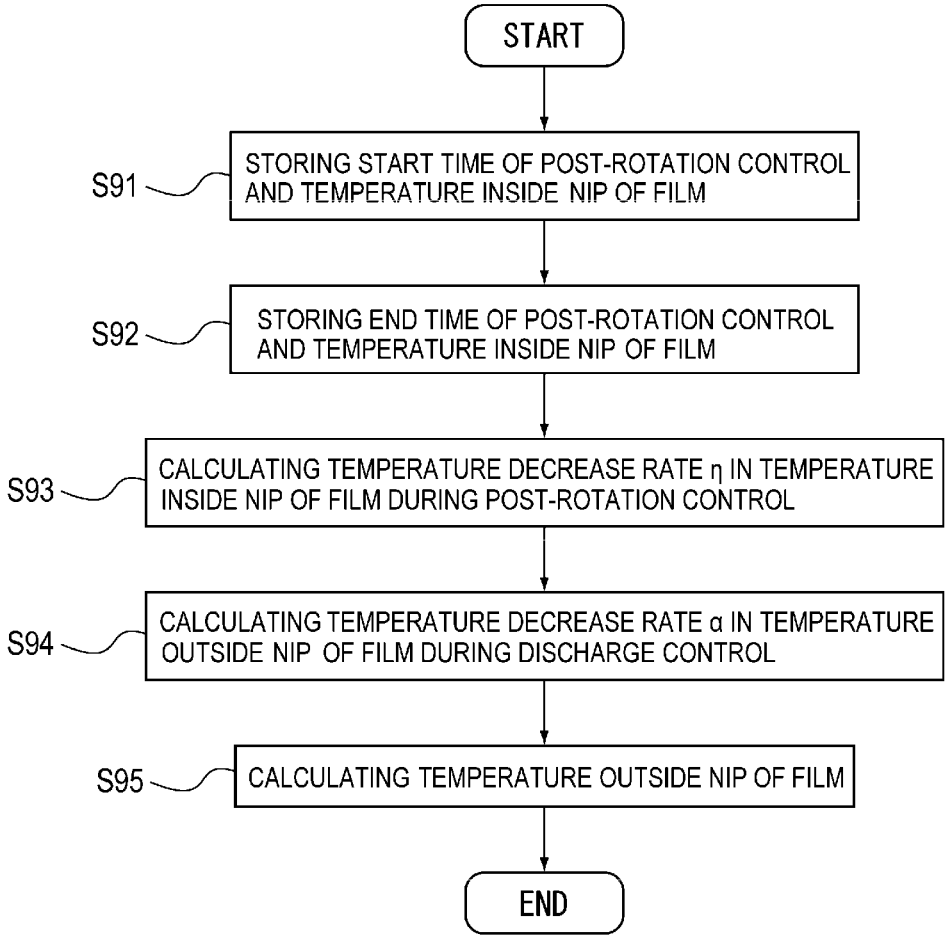
FIG. 18 is a flowchart showing a control for calculating a temperature outside the nip of the film.

As shown in FIG. 18, when the energization of the heater 23 is turned off after the end of the image forming operation to start the post-rotation control, the start time of the post-rotation control is recorded in the ROM 82, and the temperature inside the nip of the film 22 is detected by the main thermistor 25*a* and is stored in the ROM 82 (S91). Next, when the driving of the fixing motor 86 is turned off and the post-rotation control is ended, the end time of the post-rotation control is recorded in the ROM 82, and the temperature inside the nip of the film 22 is detected by the main thermistor 25*a* and stored in the ROM (S92).

Next, based on an amount of a change in temperature inside the nip of the film 22 during the post-rotation control and the time of post-rotation control, an amount of a change per unit time in the temperature inside the nip in the post-rotation control is calculated as the temperature decrease rate η (See FIG. 19) (S93). In the present embodiment, the post-rotation control was performed for 2 seconds, and the temperature inside the nip of the film 22 changed from 190° C. to 120° C. so that the temperature change rate η=35.

It is known in advance by experiment that the temperature decrease rate η and the temperature decrease rate α (see FIG. 19) which is an amount of a change per unit time in the temperature outside the nip of the film 22 in the discharge control have the relationship of α=0.286η. Therefore, the temperature decrease rate α in temperature outside the nip during the discharge control is obtained as 0.286×35=10 by substituting the temperature decrease rate η (=35) into the above equation (S94).

Figure 19:
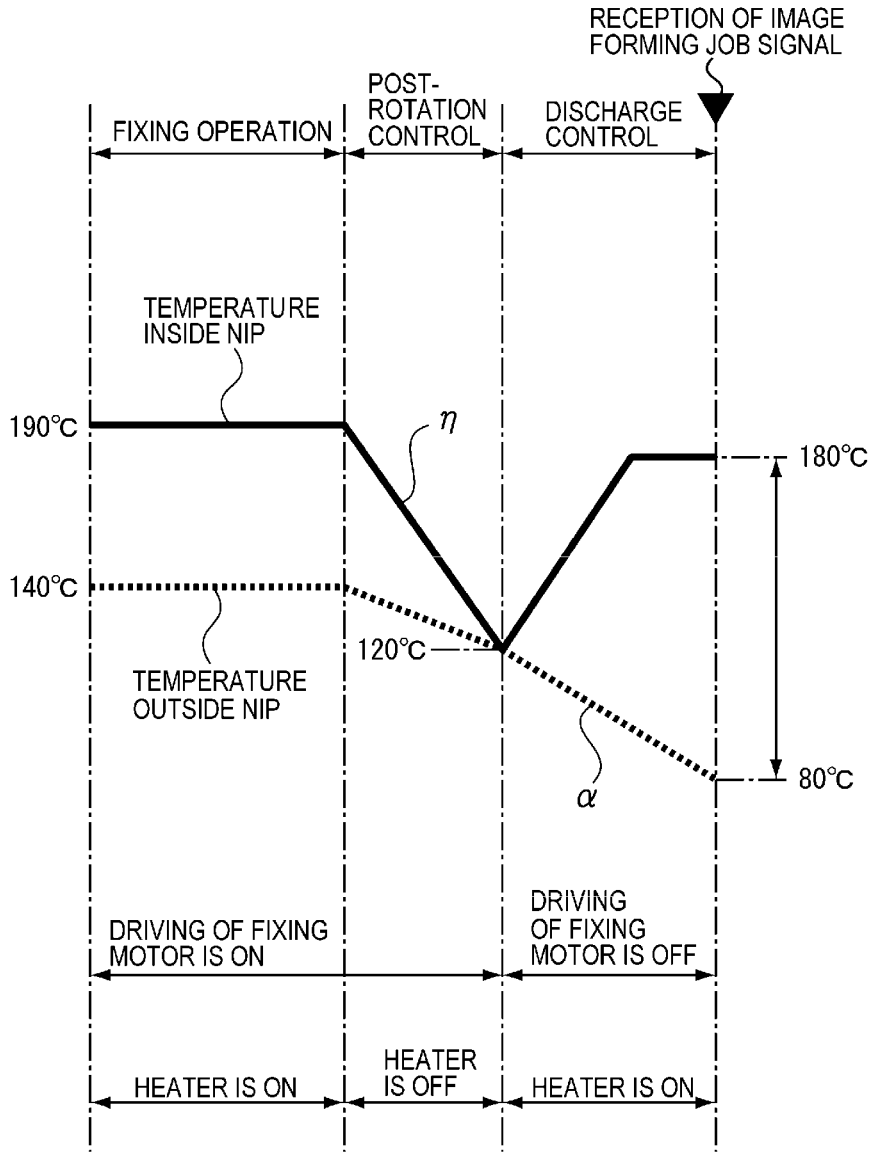
FIG. 19 is a graph showing transitions of temperatures inside the nip and outside the nip of a film from a fixing operation until a subsequent image forming job signal is received.

As described above, in the post-rotation control, temperature inside the nip and the temperature outside the nip of the film 22 become substantially equal when a certain time elapses. In the present embodiment, as shown in FIG. 19, the temperature inside the nip and temperature outside the nip of the film 22 became substantially equal to each other after two seconds have lapsed (at the end of the post-rotation control) from the start of the post-rotation control. Namely, the temperature inside the nip of the film 22 at the end of the post-rotation control detected in step S92 becomes substantially the same as temperature outside the nip of the film 22 at the start of the discharge control.

Therefore, it is possible to determine the temperature outside the nip of the film 22 based on the elapsed time from the start of the discharge control (=end of the post-rotation control). Namely, when the elapsed time from the start of the discharge control is T and the temperature inside the nip of the film 22 at the start of the discharge control is β, the temperature outside the nip θ of the film 22 is calculated by the following equation 1 (S95):

$$\theta=\beta-(\alpha T) \quad \text{(Equation 1).}$$

For example, as shown in FIG. 19, when the temperature inside the nip of the film 22 at the start of the discharge control is 120° C. and an image forming job signal is received after 4 seconds elapses from the start of the discharge control, the temperature inside the nip of the film 22 is θ=120−(4×10)=80° C. since the temperature decrease rate α=10.

As described above, instead of measuring the temperature outside the nip of the film 22 with a temperature sensor, such as a non-contact thermometer, it is calculated based on the temperature detected by the temperature sensor that detects the temperature inside the nip of the film 22, thereby reducing a number of parts and the cost.

Sixth Embodiment

Next, the sixth embodiment of the image forming apparatus A including the fixing device 11 according to the present invention will be described with reference to the drawings. The same parts as those of the first to fifth embodiments are denoted by the same reference numerals using the same figures, and the description thereof will be omitted.

Instead of measuring the temperature outside the nip of the film 22 with a non-contact thermometer (not shown) in the discharge control of the fourth embodiment, it is calculated based on an amount of change per unit time in the temperature inside the nip in the present embodiment. Namely, the detection of the temperature outside the nip of the film 22 in steps S76 and S83 described in the fourth embodiment is performed by a control described later, and the other control is the same as that in the fourth embodiment. Hereafter, the operation of calculating the temperature outside the nip of the film 22 of the present embodiment will be described with reference to the flowchart shown in FIG. 20 and a graph showing transitions of the temperature inside the nip and temperature outside the nip of the film 22 shown in FIG. 21.

Figure 20:
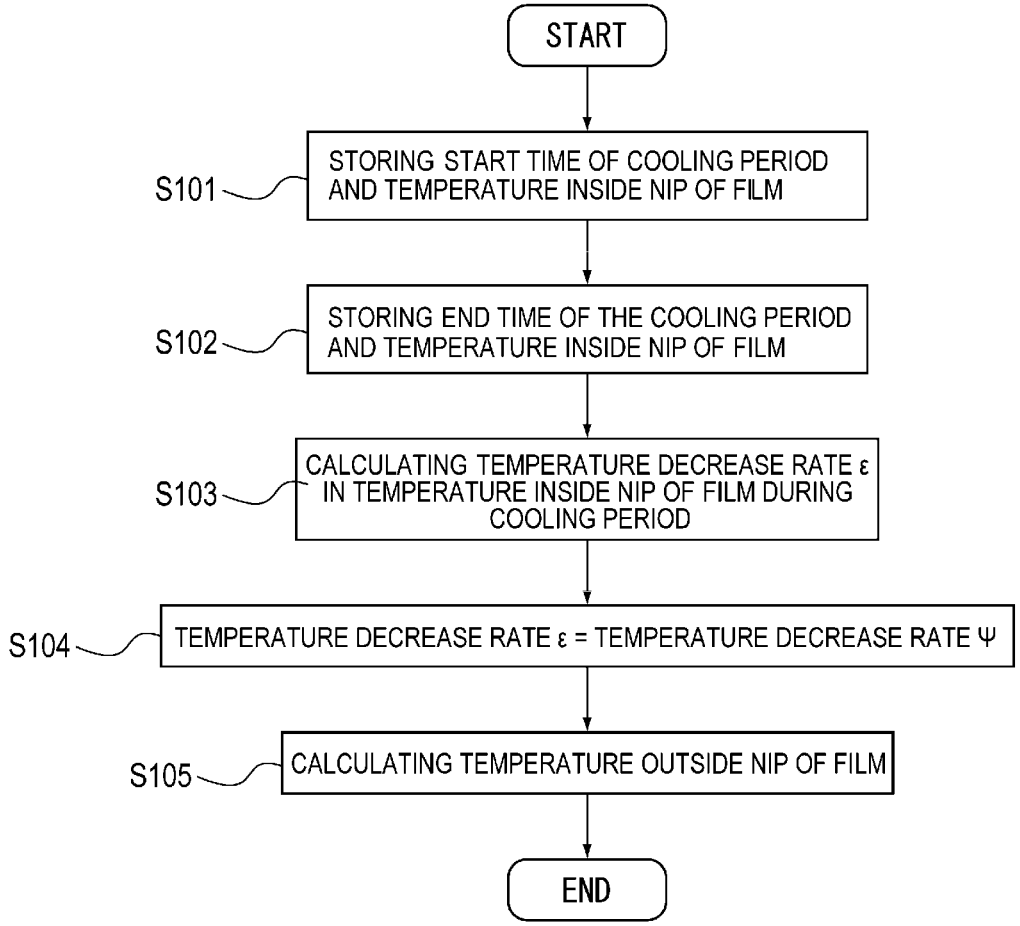
FIG. 20 is a flowchart showing a control for calculating a temperature outside the nip of the film.

As shown in FIG. 20, firstly, the start-up control is not started immediately after the completion of the post-rotation control and a cooling period is provided in which the energization of the heater 23 and the driving of the fixing motor 86 are turned off. At this time, the time at the start of the cooling period (the time when both the energization of the heater 23 and the driving of the motor are turned off) and the temperature inside the nip of the film 22 at the start of the cooling period are stored in the ROM 82 (S101). The temperature inside the nip is detected by the main thermistor 25*a*.

Next, after a predetermined time has elapsed, the energization of the heater 23 is turned on, and the discharge control is started. Namely, the time point at the start of the discharge control is the same time point as at the end of the cooling period. At this time, the time point at the start of the discharge control (at the end of the cooling period) and the temperature inside the nip of the film 22 detected by the main thermistor 25*a* are stored in the ROM 82 (S102).

Figure 21:
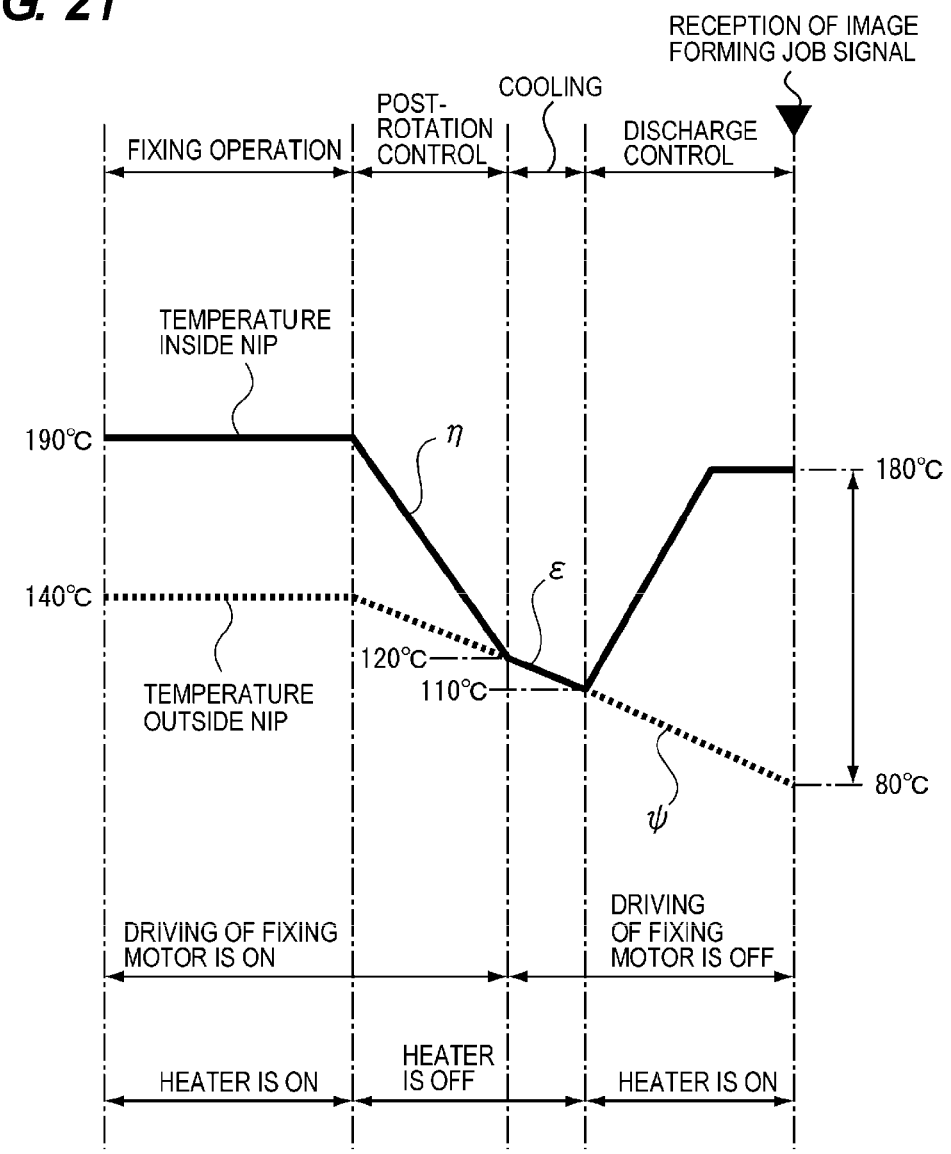
FIG. 21 is a graph showing transitions of temperatures inside the nip and outside the nip of a film from a fixing operation until a subsequent image forming job signal is received.

Next, an amount of a change per unit time in temperature inside the nip of the film 22 during the cooling period is calculated as a temperature change rate ε (S103). As shown in FIG. 21, in the present embodiment, the temperature inside the nip of the film 22 at the start of the cooling period was 120° C. and the temperature inside the nip at the end of the cooling period was 110° C. Further, the cooling period is 1 second. Therefore, the temperature change rate ε is (120−110)/1=10.

As described above, in the post-rotation control, the temperature inside the nip and the temperature outside the nip of the film 22 become substantially equal when a certain time elapses. In the present embodiment, the temperature inside the nip and the temperature outside the nip of the film 22 are almost equal to each other when the post-rotation control ends (FIG. 21). Further, during the cooling period, the energization to the heater 23 and the driving of the fixing motor 86 are turned off, so that the temperature inside the nip and the temperature the outside of the nip transition continue to remain substantially the same. Namely, the temperature inside the nip of the film 22 at the start of discharge control (at the end of the cooling period) detected in step S102 is substantially equal to the temperature outside the nip.

In addition, when the energization to the heater 23 is turned on at the start of discharge control and heating in the halt state is performed, the temperature inside the nip of the film 22 increases. The temperature outside the nip, however, decreases with the same temperature change rate as in the cooling period. Namely, the temperature decrease rate ψ, which is an amount of a change per unit time in the temperature outside the nip of the film 22 in the discharge control, and the temperature change rate ε of the temperature inside the nip of the film 22 in the cooling period are the same (See FIG. 21). Namely, since the temperature decrease rate ψ=temperature decrease rate ε, the CPU 80 sets the value of the temperature decrease rate ψ to the value of the temperature decrease rate ε (S104). This result is also found from an experiment.

Therefore, if the elapsed time from the start of the discharge control (=the end of the cooling period) is determined, the temperature outside the nip of the film 22 is determined. Namely, when the elapsed time from the start of the discharge control is T and the temperature inside the nip of the film 22 at the start of the discharge control is β, the temperature γ outside the nip of the film 22 is calculated by the following equation 2 (S105):

$$\gamma=\beta-(\psi T) \quad \text{(Equation 2).}$$

For example, as shown in FIG. 21, when then temperature β inside the nip of the film 22 at the start of discharge control is 110° C. and an image forming job signal is received after 3 seconds elapse from the start of the discharge control, the temperature inside the nip of the film 22 is θ=110−(3×10)=80° C. since the temperature decrease rate ψ=10.

As described above, instead of measuring the temperature outside the nip of the film 22 with a temperature sensor, such as a non-contact thermometer, it is calculated based on the temperature detected by the temperature sensor that detects the temperature inside the nip of the film 22, thereby reducing a number of parts and the cost.

Seventh Embodiment

Next, the seventh embodiment of the image forming apparatus A including the fixing device 11 according to the present invention will be described with reference to the drawings. The same parts as those of the first to sixth embodiments are denoted by the same reference numerals using the same figures, and the description thereof will be omitted.

Figure 22A:
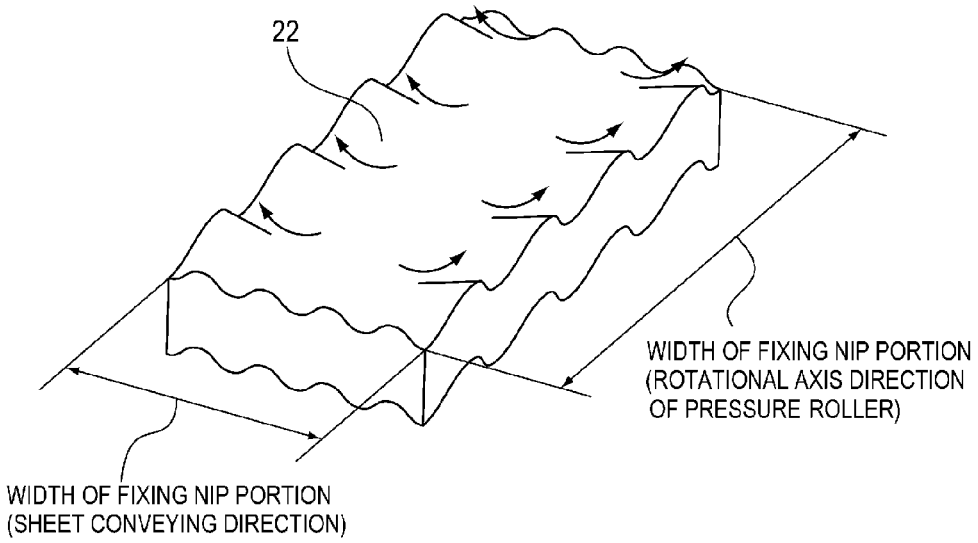
FIGS. 22A and 22B are schematic diagrams schematically showing deformation due to thermal expansion of a film when the width of the fixing nip portion is narrow and wide.
Figure 22B:
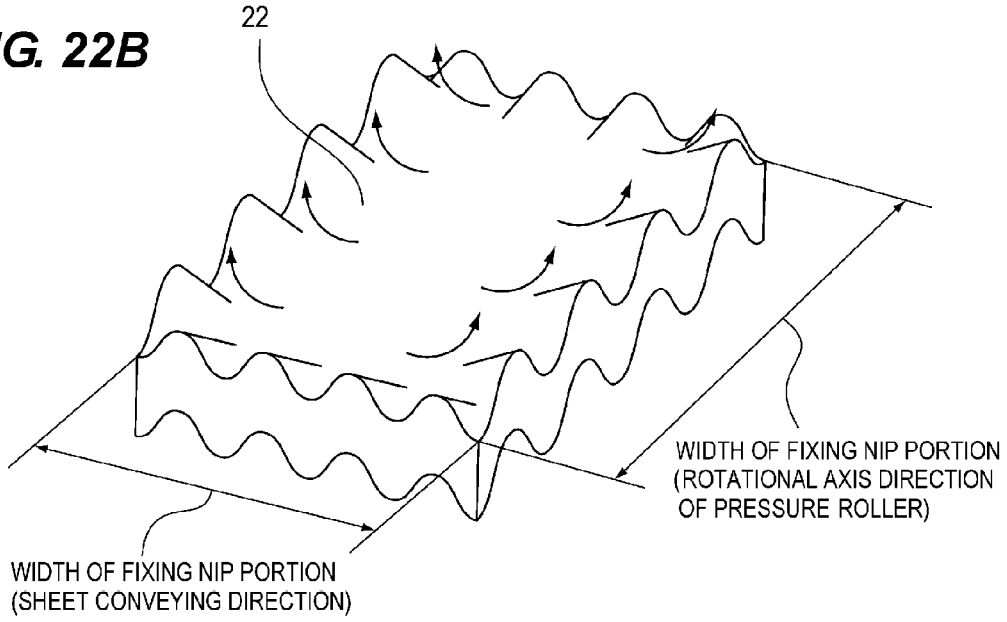

FIGS. 22A and 22B are schematic views schematically showing deformation due to thermal expansion of the film 22 in a case in which the fixing nip portion is narrow (FIG. 22A) and in a case in which it is wide (FIG. 22B).

As shown in FIGS. 22A and 22B, in the case in which the fixing nip portion is wide, the amount of elongation of the film 22 due to thermal expansion is greater than in the case in which the fixing nip portion is narrow and the amount of strain on the temperature boundary surface of the film 22 also increases. Since the fixing nip portion has not only a width in the sheet conveying direction of the fixing device 11 but also a width in the rotational axis direction of the pressure roller 24, the deformation of the film 22 occurs in both directions. In this way, when the amount of strain increases, the film 22 tends to be permanently deformed, so that a dent mark tends to easily occur. Therefore, in order to suppress the occurrence of a dent mark on the film 22, it is necessary to make smaller the temperature difference between inside the nip and outside the nip of the film 22 at the time of driving the pressure roller 24 in the case in which the fixing nip portion is wider than in the case in which the fixing nip portion is narrow.

Therefore, in the present embodiment, the temperature difference between inside the nip and outside the nip of the film 22 at the time of driving the pressure roller 24 is set according to the width of the fixing nip portion. As a result, it is possible to suppress the occurrence of a dent mark on the film 22. Hereafter, the control of the present embodiment will be described with reference to the flowchart shown in FIG. 23.

Figure 23:
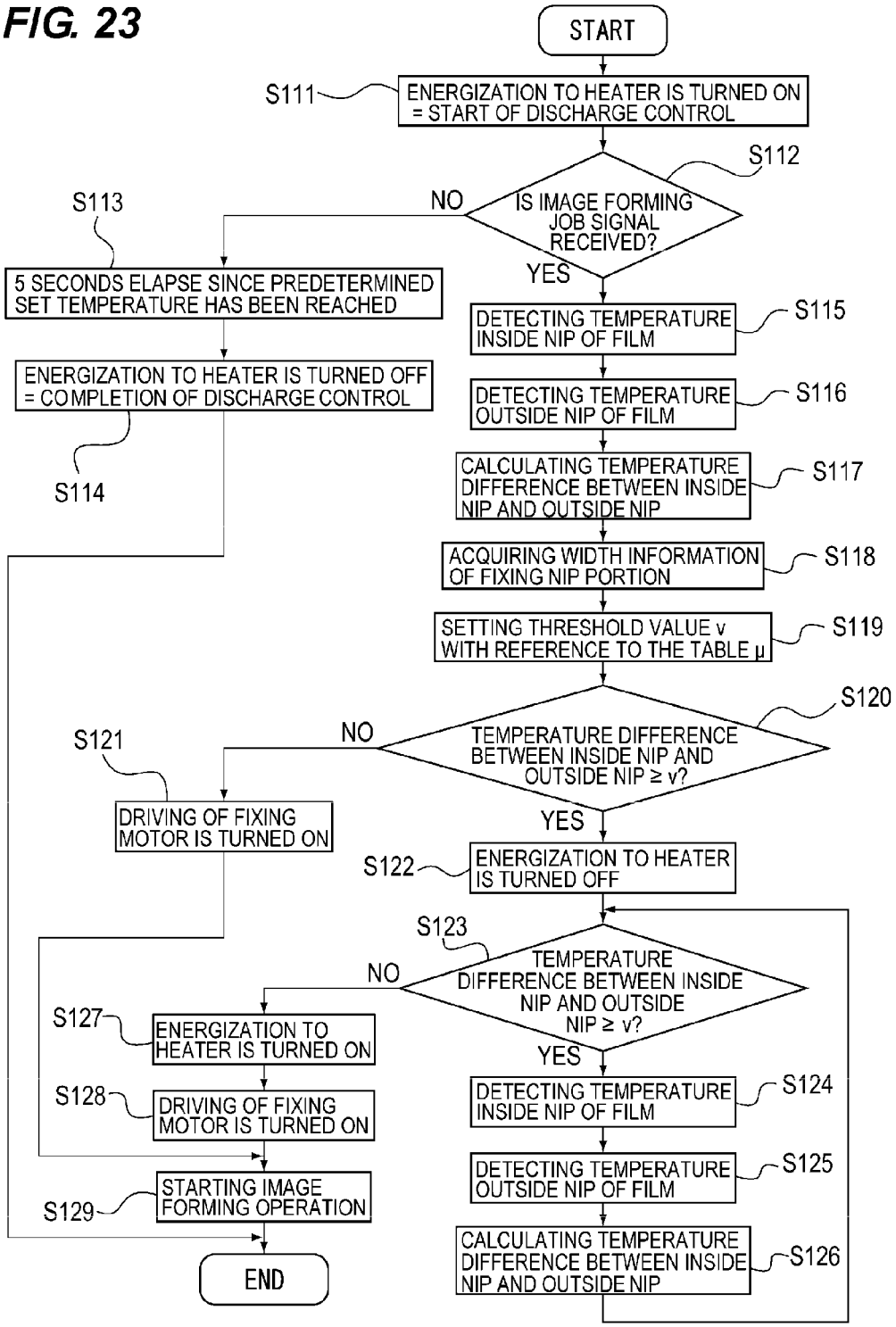
FIG. 23 is a flowchart showing a control when an image forming job signal is received during a discharge control.

As shown in FIG. 23, when the post-rotation control is finished after the fixing operation, the energization of the heater 23 is turned on while the film 22 is not rotated, and the discharge control is started (S111). Next, when an image forming job signal is not received during the discharge control, the energization to the heater 23 is turned off after 5 seconds have elapsed since the heater 23 had reached a predetermined set temperature as usual (S112 to S114), and the discharge control is completed.

On the other hand, when an image forming job signal is received during the discharge control, the temperature inside the nip and the temperature outside the nip are detected by the main thermistor 25*a* and the non-contact thermometer 89 and the temperature difference between inside the nip and outside the nip is calculated (S112, S115 to S117).

Next, the CPU 80 acquires the width information of the fixing nip portion from the ROM 82 (S118). Since the width of the fixing nip portion varies from one unit to another unit due to the variation of the members, the width information is stored in advance in the ROM 82 at the time of shipment. In the present embodiment, the width of the fixing nip portion in the sheet conveying direction (rotation direction of the film 22) at the time of shipment is 9.0 mm.

Next, the CPU 80 sets the threshold value υ with reference to the table μ (See FIG. 24) in which the width N of the fixing nip portion in the sheet conveying direction and the threshold value υ (predetermined temperature) relating to the temperature difference between inside the nip and outside the nip of the film 22 at the time of driving the pressure roller 24 are associated with each other (S119). The table μ is stored in advance in the ROM 82. Further, as shown in FIG. 24, in the table μ, the threshold υ is set to be less when the width of the fixing nip portion is greater. In the present embodiment, since the width N of the fixing nip portion in the sheet conveying direction is 9.0 mm, the threshold value υ is set to 80° C.

Next, the CPU 80 judges whether or not the temperature difference between inside the nip and outside the nip of the film 22 is equal to or greater than the threshold value υ (S120). Namely, in the present embodiment, it is determined whether or not the temperature difference in the nip in the film 22 is 80° C. or more.

When the temperature difference between inside the nip and outside the nip of the film 22 is less than 80° C., the driving of the fixing motor 86 is turned on (S127), and the image forming operation is performed (S129).

On the other hand, when the temperature difference between inside the nip and outside of the nip of the film 22 is 80° C. or more, instead of immediately performing the image forming operation, the energization to the heater 23 is turned off and the cooling operation is performed (S123). Thereafter, when the temperature difference between inside the nip and outside the nip of the film 22 is detected again (S124 to S126) and when the temperature difference is within 80° C., the energization of the heater 23 is turned on (S127) and the driving of the fixing motor 86 is turned on (S128) to perform the image forming operation (S129).

By setting the temperature difference between inside the nip and outside the nip of the film 22 at the time of driving the pressure roller 24 according to the width of the fixing nip portion as described above, even in a fixing device 11 with a wide fixing nip portion, the generation of a dent mark on the film 22 can be suppressed.

In the present embodiment, the threshold value υ is set based on the width in the sheet conveying direction at the fixing nip portion. The present invention is not, however, limited thereto and the threshold υ may be set based on the width in the rotation axis direction of the pressure roller 24.

Eighth Embodiment

Next, the eighth embodiment of the image forming apparatus A including the fixing device 11 according to the present invention will be described with reference to the drawings. The same parts as those of the first to seventh embodiments are denoted by the same reference numerals using the same figures, and the description thereof will be omitted.

Figure 25:
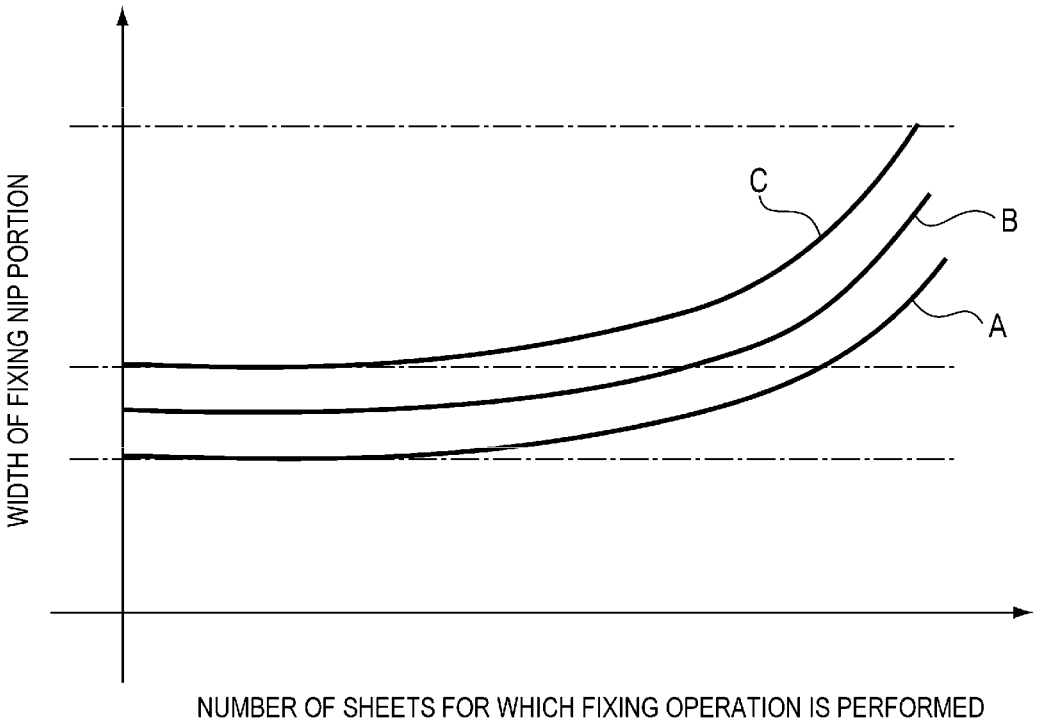
FIG. 25 is a graph showing the relationship between the number of sheets fixed by the fixing device and the width of the fixing nip portion.

FIG. 25 is a graph showing the relationship between the number of sheets fixed by the fixing device 11 and the width of the fixing nip portion of the fixing device 11. As shown in FIG. 25, as the number of fixed sheets increases, the width of the fixing nip portion gradually increases due to the occurrence of softening, deterioration, or the like, of the rubber of the pressure roller 24. Each of the line A, the line B, and the line C shows the change in the width of the fixing nip portion of a different fixing device 11. As described above, the width of the fixing nip portion varies from one unit to another unit due to the variation of the members.

Therefore, in the present embodiment, the width of the fixing nip portion is determined and the temperature difference between inside the nip and outside the nip of the film 22 in the state in which the pressure roller 24 is driven is set according to the determined width of the fixing nip portion. Hereafter, the control of the present embodiment will be described with reference to the flowchart shown in FIG. 26.

Figure 26:
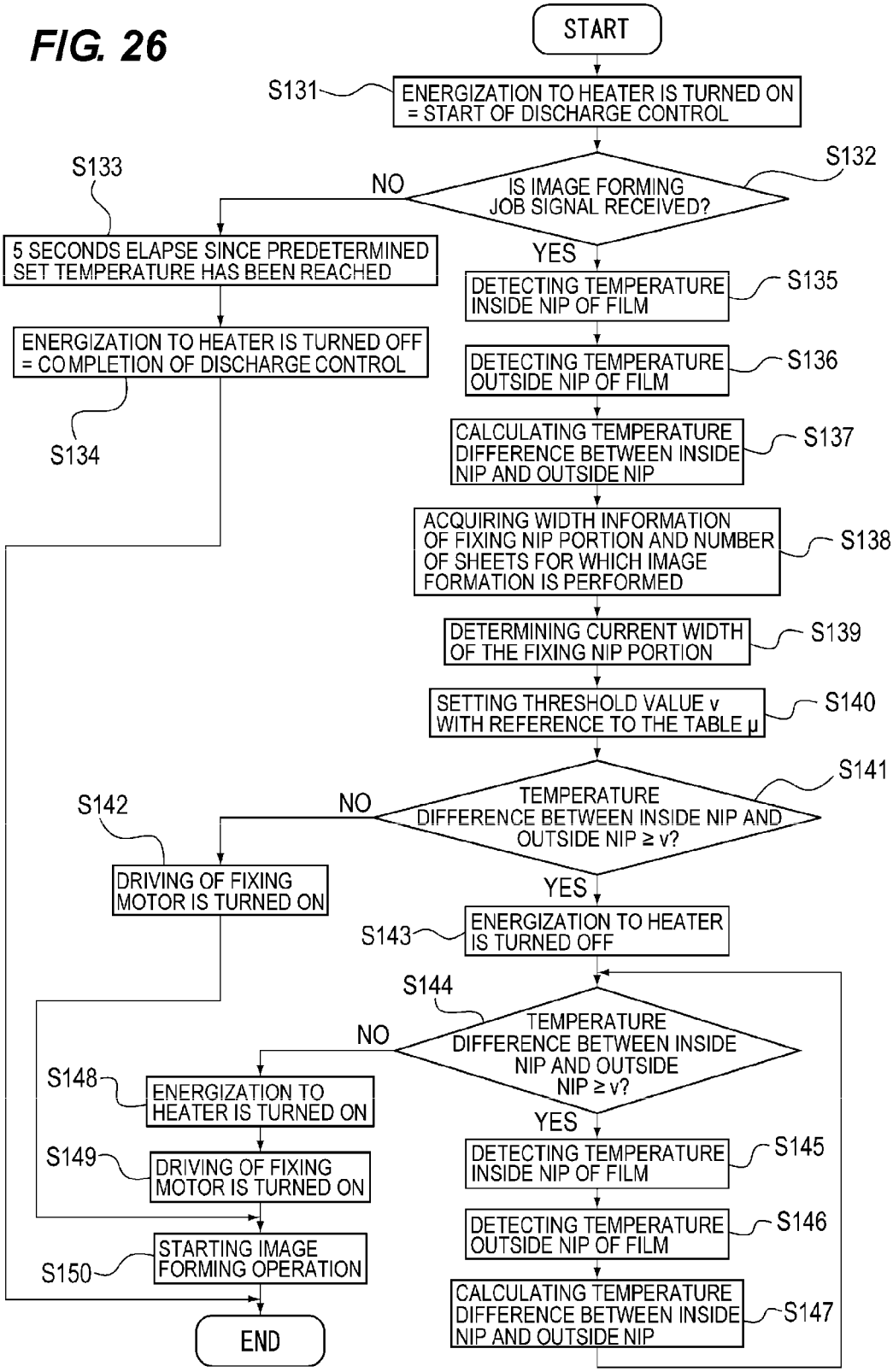
FIG. 26 is a flowchart showing a control when an image forming job signal is received during a discharge control.

As shown in FIG. 26, when the post-rotation control is completed after the fixing operation, the energization to the heater 23 is turned on while the film 22 is not rotated and the discharge control is started (S131). Next, when an image forming job signal is not received during the discharge control, the energization to the heater 23 is turned off after 5 seconds have elapsed since the heater 23 had reached a predetermined set temperature as usual (S132 to S134), and the discharge control is completed.

On the other hand, when an image forming job signal is received during the discharge control, the temperature inside the nip and the temperature outside the nip are detected by the main thermistor 25*a* and the non-contact thermometer 89, and the temperature difference between inside the nip and outside the nip is calculated (S132, S135 to S137).

Next, the CPU 80 acquires the width information of the fixing nip portion at the time of shipment and the current number of sheets to which the image formation is performed (S138). The width information of the fixing nip portion is stored in advance in the ROM 82 at the time of shipment. In the present embodiment, the width N of the fixing nip portion in the sheet conveying direction at the time of shipment is 9.5 mm. Based on these pieces of information, the current width of the fixing nip portion is determined as described below (S139).

In the present embodiment, it has been experimentally confirmed that the amount of increase Δ of the width of the fixing nip portion has the relationship $\Delta=2\times10-5\times n$ (mm) where the number of formed images is n. Therefore, for example, when it is assumed that the current number of sheets to which the image formation is performed is 50,000, it is determined that the current width N of the fixing nip portion in the sheet conveyance direction is 10.5 mm. Namely, the CPU 80 determines that the width of the fixing nip portion is greater as the cumulative number of sheets to which the fixing operation is performed by the fixing device 11 is greater.

In the present embodiment, as in the seventh embodiment, the table μ (See FIG. 24) is stored in ROM 82 in advance. In the table μ, the width N of the fixing nip portion in the sheet conveying direction and the threshold value υ (predetermined temperature) relating to the temperature difference between inside the nip and outside the nip of the film 22 at the time of driving the pressure roller 24 are associated with each other. Accordingly, the CPU 80 sets the threshold value υ with reference to the table μ based on the determined width of the fixing nip portion (S140). In the present embodiment, the threshold value υ is set to 70° C.

Next, it is determined whether or not the temperature difference between inside the nip and outside the nip of the film 22 is equal to or greater than the threshold value υ (S141). Namely, in the present embodiment, it is determined whether or not the temperature difference between inside the nip and outside the nip of the film 22 is 70° C. or more.

When the temperature difference inside the nip and outside the nip of the film 22 is less than 70° C., the driving of the fixing motor 86 is turned on (S142), and the image forming operation is performed (S150).

On the other hand, when the temperature difference between inside the nip and outside of the nip of the film 22 is 70° C. or more, instead of immediately performing the image forming operation, the energization to the heater 23 is turned off and the cooling operation is performed (S143). Thereafter, when the temperature difference between inside the nip and outside the nip of the film 22 is detected again (S145 to S147) and, when the temperature difference is within 70° C., the energization to the heater 23 is turned on (S148) and the driving of the fixing motor 86 is turned on (S149) to perform the image forming operation (S150).

By setting the temperature difference between inside the nip and outside the nip of the film 22 at the time of driving the pressure roller 24 according to the width of the fixing nip portion that has been determined, even when the width of the fixing nip portion varies depending on the situation of usage, the generation of a dent mark on the film 22 can be suppressed.

In the present embodiment, the threshold value υ is set based on the width in the sheet conveying direction at the fixing nip portion. The present invention is not, however, limited thereto and the threshold υ may be set based on the width in the rotation axis direction of the pressure roller 24.

In addition to the method of detecting the temperature outside the nip of the film 22 described in the first to eighth embodiments, the configuration can be adopted in which the temperature transition table of the temperature outside the nip of the film 22 is previously stored in the ROM 82 to obtain the same effect as described above While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

What is claimed is:

1. A fixing device, comprising:

a rotating unit;

a heating unit configured to heat the rotating unit;

a pressure member configured to nip a recording material between the rotating unit and the pressure member and to convey the recording material; and a control portion configured to variably control, when the rotating unit is changed from a rotating state to a halt state, a heating temperature of the heating unit in the halt state according to the heating temperature of the heating unit in the rotating state.

2. The fixing device according to claim 1, wherein the control portion sets the heating temperature in the rotating state according to information of a basis weight of the recording material.

3. A fixing device comprising:

a rotating unit;

a heating unit configured to heat the rotating unit;

a pressure member configured to nip a recording material between the rotating unit and the pressure member and to convey the recording material; and a control portion configured to control, when the rotating unit is changed from a rotating state to a halt state, whether or not a heating operation of the heating unit is to be performed in the halt state according to a heating temperature of the heating unit in the rotating state.

4. The fixing device according to claim 3, wherein the control portion sets the heating temperature in the rotating state according to information of a basis weight of the recording material.

5. A fixing device comprising:

a rotating unit;

a heating unit configured to heat the rotating unit;

a pressure member configured to nip a recording material between the rotating unit and the pressure member and to convey the recording material; and a setting portion configured to set a heating temperature of the heating unit when the rotating unit is changed from a rotating state to a halt state, wherein, when a heating temperature of the heating unit in the rotating state is a first temperature, the setting portion sets the heating temperature of the heating unit in the halt state to a second temperature, and, when a heating temperature of the heating unit in the rotating state is a third temperature that is less than the first temperature, the setting portion sets a heating temperature of the heating unit in the halt state to a fourth temperature that is less than the second temperature.

6. The fixing device according to claim 1, wherein the rotating unit is a cylindrical film.

* * * * *